US006473582B2

(12) United States Patent
Ishiyama et al.

(10) Patent No.: US 6,473,582 B2
(45) Date of Patent: Oct. 29, 2002

(54) CONTACT-TYPE CHARGING DEVICE HAVING A PLURALITY OF PROJECTIONS OVER THE SURFACE OF THE CHARGING DEVICE

(75) Inventors: Harumi Ishiyama, Numazu; Yasunori Chigono, Susono; Jun Hirabayashi, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/152,297

(22) Filed: Sep. 14, 1998

(65) Prior Publication Data

US 2002/0021917 A1 Feb. 21, 2002

(30) Foreign Application Priority Data

| | | |
|---|---|---|
| Sep. 12, 1997 | (JP) | 9-267739 |
| Sep. 12, 1997 | (JP) | 9-267740 |
| Sep. 12, 1997 | (JP) | 9-267741 |
| May 14, 1998 | (JP) | 10-150612 |
| May 14, 1998 | (JP) | 10-150613 |
| May 14, 1998 | (JP) | 10-150614 |

(51) Int. Cl.[7] ..... G06G 15/02
(52) U.S. Cl. ..... 399/175; 361/225
(58) Field of Search ..... 399/168, 174, 399/175, 176; 361/225; 492/28, 30, 33, 34, 37

(56) References Cited

U.S. PATENT DOCUMENTS

| | | | | |
|---|---|---|---|---|
| 4,380,384 A | * | 4/1983 | Ueno et al. | 399/176 |
| 5,432,037 A | | 7/1995 | Nishikiori | 430/126 |
| 6,163,671 A | * | 12/2000 | Ishiyama et al. | 399/176 |
| 6,233,419 B1 | * | 5/2001 | Chigono et al. | 399/176 |

FOREIGN PATENT DOCUMENTS

| | | | |
|---|---|---|---|
| JP | 63-149669 | | 6/1988 |
| JP | 3-103878 | | 4/1991 |
| JP | 4-309972 | * | 11/1992 |
| JP | 4-335684 | * | 11/1992 |
| JP | 6-3921 | | 1/1994 |
| JP | 8-305129 | * | 11/1996 |
| JP | 10-148997 | * | 6/1998 |
| JP | 11-72991 A | * | 3/1999 |

* cited by examiner

*Primary Examiner*—Quana M. Grainger
(74) *Attorney, Agent, or Firm*—Fitzpatrick, Cella, Harper & Scinto

(57) ABSTRACT

A charging apparatus includes a charging member for being supplied with a voltage to charge a member to be charged, the charging member including an elastic member for forming a nip with the member to be charged, and said elastic member having a surface provided with a plurality of projections; wherein a speed A of a surface of said charging member (mm/sec) and a speed B of a surface of the member to be charged (mm/sec) satisfy: when B−A>0, said projections are inclined toward upstream with respect to a movement direction of the surface of the member to be charged in said nip, and when B−A<0, the projections are inclined toward downstream with respect to a movement direction of the surface of the member to be charged in said nip.

43 Claims, 17 Drawing Sheets

CONTACT-TYPE CHARGING DEVICE HAVING A PLURALITY OF PROJECTIONS OVER THE SURFACE OF THE CHARGING DEVICE

FIELD OF THE INVENTION AND RELATED ART

The present invention relates to a charging device having a charging member for charging a member to be charged such as a photosensitive member or a dielectric member, and an image forming apparatus having the same.

Heretofore, a corona type charger (corona discharging device) has been widely used as a charging apparatus for charging (inclusive of discharging) an image bearing member (member to be charged) such as an electrophotographic photosensitive member or an electrostatic dielectric recording member to a predetermined polarity and a predetermined potential level in an image forming apparatus, for example, an electrophotographic apparatus or an electrostatic recording apparatus.

The corona type charging device is a non-contact type charging device, and comprises a corona discharging electrode such as a wire electrode, and a shield electrode which surrounds the corona discharging electrode. It is disposed so that corona discharging opening thereof faces an image bearing member, that is, a member to be charged. In usage, the surface of an image bearing member is charged to a predetermined potential level by being exposed to discharge current (corona shower) generated as a high voltage is applied between the corona discharging electrode and the shield electrode.

Recently, a charging device of a contact type (contact charging device) is put into practice wherein the member to be charged is charged by contacting the charging member supplied with a voltage to the member to be charged in view of its advantage of lower production of ozone and lower required electric power, as compared with the corona charger.

In order to charge a member such as an image bearing member with the use of a contact type charging apparatus, the electrically conductive charging member (contact type charging member, contact type charging device, or the like) of a contact type apparatus is placed in contact with the member to be charged, and an electrical bias (charge bias) of a predetermined level is applied to this contact type charging member so that surface of the member to be charged is charged to a predetermined polarity and a predetermined potential level. The charging member is available in various forms, for example, a roller type (charge roller), a fur brush type, a magnetic brush type, a blade type, and the like.

When a member is electrically charged by a contact type charging member, two types of charging mechanisms (charging mechanism or charging principle:

(1) mechanism which discharges electrical charge, and (2) mechanism for injecting charge) come into action. Thus, the characteristics of each of contact type charging apparatuses or methods are determined by the charging mechanism which is the dominant one of the two in charging the member. FIG. 11 shows a typical charging properties of them.

(1) Electrical Discharge Based Charging Mechanism

With this mechanism, the surface of the member to be charged is charged by the discharge development occurring in the small gap between the contact charging member and the member to be charged.

In the case of the electrical discharge based charging mechanism there is a threshold voltage which must be surpassed by the charge bias applied to a contact type charging member before electrical discharge occurs between a contact type charging member and a member to be charged, and therefore, in order for the member to be charged through the electrical discharge based charging mechanism, it is necessary to apply to the contact type charging member a voltage with a value greater than the value of the potential level to which the member is to be charged. Thus, in principle, when the electrical discharge based charging mechanism is in action, the discharge product is unavoidable, that is, active ions such as ozone ions are produced, even though the amount thereof is remarkably small.

For example, a charging type using the electroconductive roller(charging roller) as the contact charging member is widely used because of its charging stability, but the discharge-using charging mechanism is dominant in the roller charging.

The charging roller comprises a rubber material or foam member having an electroconductivity or an intermediate resistance. In some charge rollers, the rubber or foamed material is layered to obtain a specific characteristic.

In order to maintain stable contact between a charge roller and a member to be charged, a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. Therefore, occurrence of local non-contact state is unavoidable due to the non-uniformity of the roller shape and the deposited matter on the member to be charged. For this reason, discharge-using charging mechanism is dominant in the conventional charging mechanism using the roller charging. More particularly, when a charging roller is press-contacted to an OPC photosensitive member having a thickness of 25 $\mu$m (member to be charged) to effect charging thereof, the charging roller is supplied with a voltage of not less than approx. 640 V, by which the surface potential of the photosensitive member starts to rise, and thereafter, with increase of the applied voltage, the surface potential of the photosensitive member rises linearly with inclination 1. Such a starting threshold voltage is called charge starting voltage Vth (broken line in FIG. 11).

In other words, in order to charge the surface of a photosensitive member to a potential level of $V_d$ which is necessary for electrophotography, a DC voltage of $(V_d+V_{th})$, which is higher than the voltage level to which the photosensitive member is to be charged, is necessary. Hereinafter, the above described charging method in which only DC voltage is applied to a contact type charging member to charge a member will be called "DC charging method".

As for a counter measure for the above described problem, Japanese Laid-Open Patent Application No. 149, 669/1988 discloses an invention which deals with the above problem to effect more uniform charging of a photosensitive member. According to this invention, a "AC charging method" is employed, in which a compound voltage composed of a DC component equivalent to a desired potential level $V_d$, and an AC component with a peak-to-peak Voltage which is twice the threshold voltage $V_{th}$, is applied to a contact type charging member. This is intended to utilize the averaging effect of alternating current. That is, the potential of the image bearing member to be charged is caused to converge to the $V_d$, that is, the center of the peaks of the AC voltage, without being affected by external factors such as operational ambience.

However, even in the case of the contact type charging apparatus in the above described invention, the principal charging mechanism is a charging mechanism which uses electrical discharge from a contact type charging member to the image bearing member. Therefore, as already described, the voltage applied to the contact type charging member needs to have a voltage level higher than the surface potential plus the discharge threshold. Thus, ozone is generated, although only in a small amount.

Further, when AC current is used so that member is uniformly charged due to the averaging effect of AC current, the problems related to AC voltage become more conspicuous. For example, more ozone is generated; noises traceable to the vibration of the contact type charging member and the photosensitive drum caused by the electric field of AC voltage increase; the deterioration of the photosensitive member surface caused by electrical discharge increases, which add to the prior problems.

(2) (2) Direct Charge Injection Mechanism

This is a mechanism in which the surface of a member to be charged is charged as electrical charge is directly injected into the member to be charged, with the use of a contact type charging member. This is proposed in Japanese Laid-open Patent Application No. HEI- 6-3921 or the like.

A contact type charging member with medium electrical resistance is placed in contact with the surface of a member to be charged to directly inject electrical charge into the surface portion of a member to be charged, without relying on electrical discharge, in other words, without using electrical discharge in principle. Therefore, even if the value of the voltage applied to a contact type charging member is below the discharge starting voltage value, the member to be charged can be charged to a voltage level which is substantially the same as the level of the voltage applied to the contact type charging member (solid line in FIG. 11 ) This direct injection charging mechanism does not suffer from the problems caused by the by-product of electrical discharge since it is not accompanied by ozone production.

More particularly, a voltage is applied to the contact charging member such as a charging roller, a charging brush or a charging magnetic brush to inject the charge to the charge retaining member such as a charge injection layer, electroconductive particles or the like or the trap level of the surface of the member to be charged(image bearing member) (direct injection charging). Since the discharge phenomenon is not dominant in this type, the voltage required for the charging is only the desired surface potential of the image bearing member, and therefore, there is no ozone production.

When the contact member comprises a porous roller such as a sponge roller and electroconductive particles thereon for improving the contact charging property, the contact between the contact charging member and the member to be charged can be made very close, so that satisfactory charging property can be provided.

Toner recycling process (cleanerless system)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that waste toner is not produced. Thus, image forming apparatuses capable of recycling toner have been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by tog removal bias (voltage level difference Vback between the level of the DC voltage applied to a developing apparatus and the level of the surface potential of a photosensitive member) during the following image transfer.

According to this cleaning method, the residual toner is recovered by the developing apparatus and is used for the following image development and thereafter; the waste toner is eliminated. Therefore, the labor spent for maintenance is reduced. Further, being cleanerless is quite advantageous in terms of space, allowing image forming apparatuses to be substantially reduced in size.

E) Coating Of Contact Type Charging Member With Electrically Conductive Powder

Japanese Laid-Open Patent Application No. 103, 878/1991 discloses a contact type charging apparatus with such a structure that coats a contact type charging member with electrically conductive powder, on the surface which comes in contact with the surface of a member to be charged, so that surface of the member to be charged is uniformly charged, that is, without irregularity in charge. The contact type charging member in this charging apparatus is rotated by the rotation of the member to be charged (without peripheral speed difference), and the amount of ozone generated by this charging apparatus is remarkably small compared to the amount of ozonic products generated by a corona type charging apparatus such as scorotron. However, even in the case of this charging apparatus, the principle, based on which a member is charged, is the same as the principle, based on which a member is charged by the aforementioned charge roller; in other words, a member is charged by electrical discharge. Further, also in the case of this charging apparatus, in order to assure that member to be charged is uniformly charged, compound voltage composed of DC component and AC component is applied to the contact type charging member, and therefore, the amount of ozonic products traceable to electrical discharge becomes relatively large. Thus, even this contact type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

U.S. Pat. No. 5,432,037 discloses an image forming method using a contact charging wherein in order to avoid the charging problem due to deposition of the fine silica particles or toner particles during repeated long term image formation on the surface of the charging means, the developer contains at least visualizing particles and electroconductive particles having an average particle size smaller than that of the visualizing particles. However, the contact charging is based on the discharge-charging mechanism rather than the direct injection charging mechanism, and therefore, involves the above-described problems attributable to the discharging.

As described in the preceding paragraphs regarding the technologies prior to the present invention, it is difficult to directly charge a member with the use of a contact type charging apparatus with a simple structure which comprises a contact type charging member such as a charge roller or a fiber brush. Also in the case of an image forming apparatus which employs such a charging apparatus, the photosensitive member is liable to be insufficiently charged, causing images to appear foggy (during reversal development, toner is adhered to the areas which are supposed to remain white), or the photosensitive member is liable to be non-uniformly charged, causing image to be appear irregular in terms of continuity.

In the case of the contact type charging apparatus structured so that contact type charging member is rotated by the rotation of the photosensitive member, and so that photosensitive member is mainly charged by electrical discharge, ozonic products are liable to be accumulated, and images are affected by the accumulated ozonic products, appearing as if flowing, when such a charging apparatus is used for an extended period of time, in particular, when such a charging apparatus is used in a cleanerless image forming apparatus for an extended period of time.

Further, particularly in the case of the cleanerless image forming apparatus, there is the problem that residual toner causes the photosensitive member to be unsatisfactorily charged in a charging portion.

SUMMARY OF THE INVENTION

Accordingly, it is a principal object of the present invention to provide a charging device and an image forming apparatus wherein the contact property between the charging member and the member to be charged is improved even with the use of a simple member as a charging member.

It is another object of the present invention to provide a charging device and an image forming apparatus wherein the applied voltage to the charging member can be lowered so that substantially ozoneless charging accomplished.

It is a further object of the present invention to provide a charging device and an image forming apparatus wherein defect due to ozone product is avoided.

It is a further object of the present invention to provide a charging device and an image forming apparatus wherein infection charging is effected in a nip formed between a charging member and a member to be charged at low cost.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
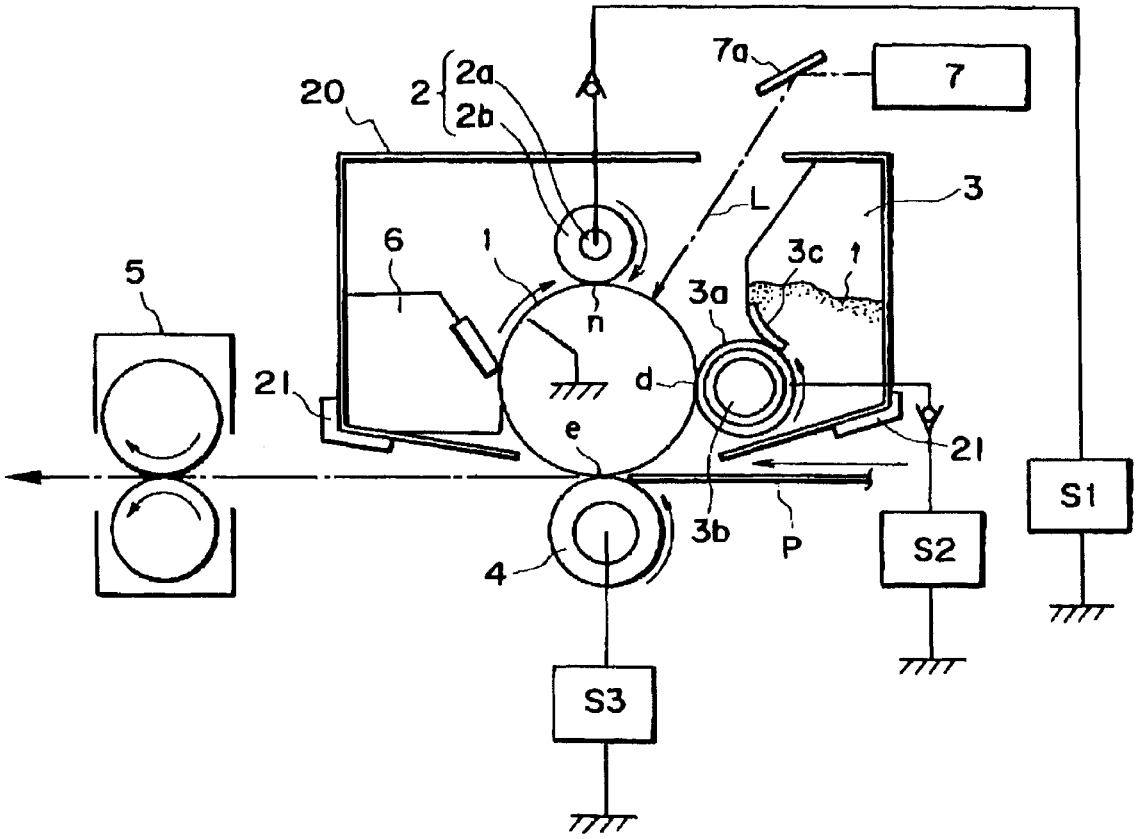
FIG. 1 is a schematic view of an image forming apparatus according to Embodiment 1.

In this embodiment, the present invention is embodied in the form of an image forming apparatus equipped with a charging apparatus. FIG. 1 is a schematic vertical section of the image forming apparatus, and depicts its general structure.

The image forming apparatus in this embodiment is a laser printer (recording apparatus), which employs a transfer type electrophotographic process, a replaceable process cartridge, and a contact type charging system.

(1) General Structure of Printer

Reference number 1 designates an OPC type photosensitive member (negatively chargeable type), that is, an image bearing member (member to be charged), with a diameter of 30 mm. The photosensitive member 1 is in the form of a rotatable drug, and is rotatively driven in the clockwise direction indicated by an arrow mark at a predetermined process speed (peripheral velocity) of B mm/sec.

Reference number 2 designates a charge roller with a diameter of 12 mm, that is, a contact type charging member for charging the photosensitive member 1. This charge roller 2 comprises an elastic layer, and has a large number of slant projections on its peripheral surfaces. This charge roller 2 will be described in detail in Section 2.

The charge roller 2 is placed in contact with the photosensitive member 1 in a manner to generate a predetermined contact pressure so that a nip with a predetermined width is formed between the peripheral surfaces of the charge roller 2 and the elastic layer of the photosensitive member 1. This nip portion (charging station) between the charge roller 2 and the photosensitive member 1 is designated with a referential character n.

In this embodiment, the charge roller 2 is rotatively driven at a predetermined peripheral velocity of A mm/sec, in the clockwise direction indicated by the arrow mark, that is, in such a direction that in the charging nip n, its rotational direction becomes opposite (counter) to the direction in which the photosensitive member 1 is rotated. In other words, the peripheral surface of the charge roller 2 makes contact with the peripheral surface of the photosensitive member 1, maintaining a predetermined velocity difference.

As a predetermined charge voltage is applied to the charge roller 2 from a charge bias application power source S1, the peripheral surface of the rotating photosensitive member 1 is uniformly charged to the predetermined polarity and a predetermined potential level (contact type charging process). In this embodiment, a DC voltage of −700 V is applied as the charge voltage to the metallic core 2*a* of the charge roller 2 from the charge bias application power source S1.

Figure 11:
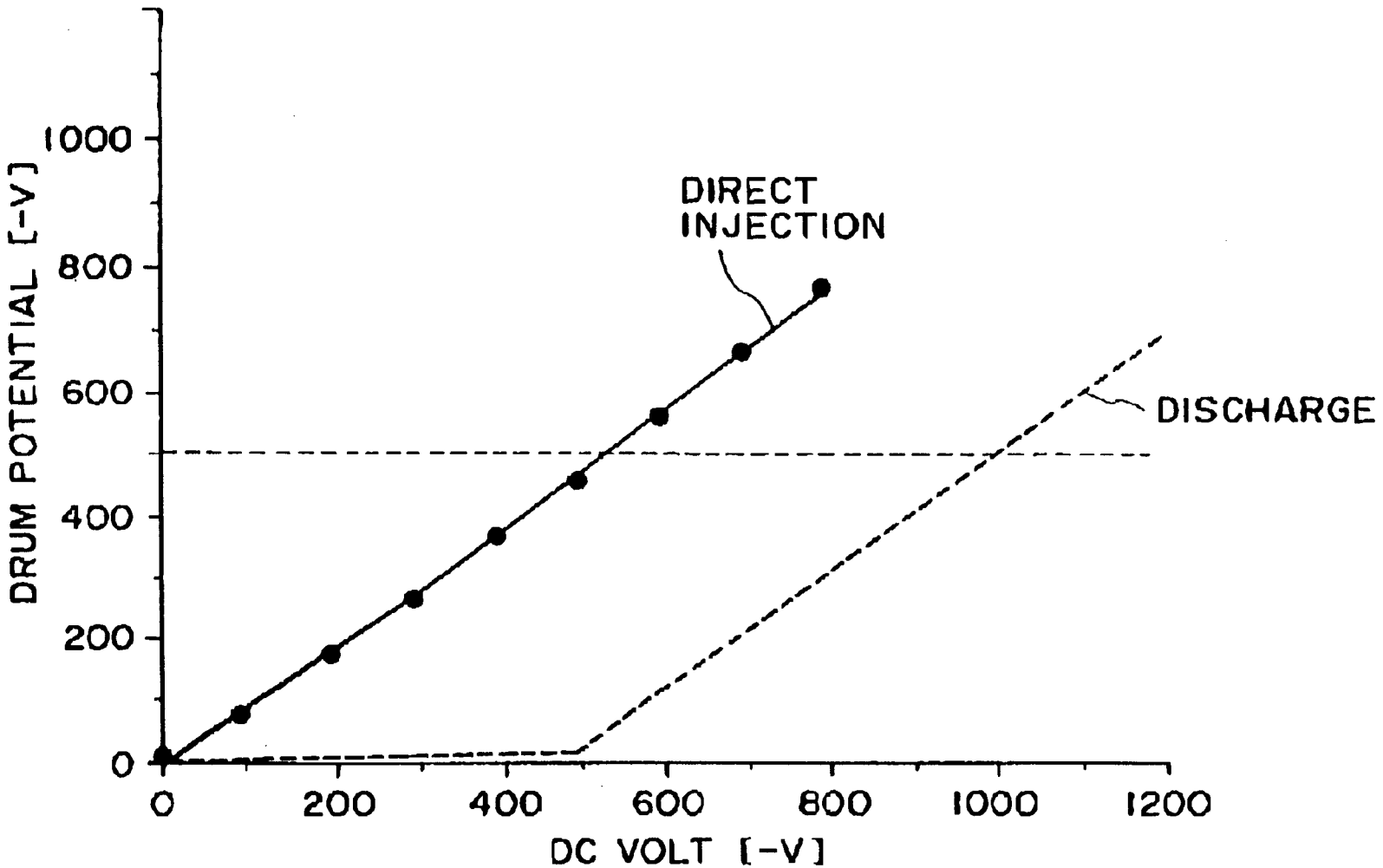
FIG. 11 is a charging property graph.

In the case of the contact type charging process in this embodiment, the photosensitive member 1 is charged by the charge roller 2 dominantly through direct charge injection, and the peripheral surface of the photosensitive member 1 is charged to a potential level substantially equal to the level of the charge voltage applied to the charge roller 2, as shown by a bold line in FIG. 11. This process will be described in detail also in Section 2.

Reference number 7 designates a laser beam scanner (exposing device) comprising a laser diode, a polygon mirror, and the like. This laser beam scanner outputs a laser beam L modulated with sequential electrical digital signals reflecting the image data of a desired image. It scans, or exposes, the uniformly charged peripheral surface of the rotating photosensitive member 1. A referential alphanumeric code 7*a* designates a mirror which deflects the laser beam L outputted from the laser beam scanner 7, toward the portion of the photosensitive member 1 to be exposed. As the peripheral surface of the rotating photosensitive member 1 is scanned by, or exposed to, this scanning exposing beam L, an electrostatic latent image reflecting the image data of the desired image is formed on the peripheral surface of the rotating photosensitive member 1.

Reference number 3 designates a developing apparatus, by which the electrostatic latent image on the peripheral surface of the photosensitive member 1 is developed into a toner image. The developing apparatus 3 in this embodiment is a reversal type developing apparatus, which employs single component magnetic toner t (negative toner) which is electrically insulative. A referential alphanumeric code 3*a* designates a rotative, nonmagnetic developing sleeve, which contains a nonrotative magnetic roller 3*b*, and is rotatively driven in the counterclockwise direction indicated by an arrow mark at a predetermined peripheral velocity.

The single component magnetic insulative toner t in the developing apparatus is magnetically held in a layer on the peripheral surface of the developing sleeve 3*a* by the magnetic roller 3*b* in the developing sleeve 3*a*. As the developing sleeve 3*a* is rotated, the toner t is conveyed toward the development station d, which is where the peripheral surfaces of the photosensitive member 1 and the developing sleeve 3*a* directly face each other. While the toner t is conveyed toward the development station d, the toner t is regulated in its thickness, and also is electrically charged, by a regulating blade 3*c*. Then, in the development station d, the charged toner reversely develops the electrostatic latent image on the peripheral surface of the photosensitive member 1 into a toner image.

To the developing sleeve 3*a*, a predetermined development voltage is applied from a development bias application power source S2. In this embodiment, the development voltage is composed of a DC voltage of −500 V, and an AC voltage with a frequency of 180 Hz, a peak-to-peak voltage of 1600 V, and a rectangular wave form.

The magnetic, insulative single component toner t as the developer in this embodiment is composed of a binder resin, coloring material, magnetic particles, charge controlling material, and the like, using processes of mixing, kneading, pulverizing, and classifying. To the thus produced toner t, fluidizing agent is added. The weight average particle diameter (D7) of the toner is 7 $\mu$m.

Reference number 4 designates a rotative transferring roller as a contact type transferring means, which is elastic, and has an electrical resistance in a medium range. It is placed in contact with the photosensitive member 1, with a predetermined contact pressure, forming a transfer nip e (transfer station).

To this transfer nip e, a transfer sheet P as recording medium is delivered, with a predetermined timing, from an unillustrated sheet feeding portion. In the transfer nip n, a predetermined transfer voltage is applied to the transfer roller 4 from a transfer bias application power source S3, whereby the toner image on the photosensitive member 1 side is sequentially transferred onto the surface of the transfer sheet P from one end of the transfer sheet P to the other as the transfer sheet P is fed into the transfer n.

In this embodiment, a transfer roller with a resistance value of $5\times10^8$ is employed as the transfer roller 4, and a DC voltage of +2000is applied to transfer the image. More specifically, the transfer sheet P introduced into the transfer nip e is passed through the transfer nip e, being pinched between the photosensitive member 1 and the transfer roller 4, and as the transfer sheet P is passed through the transfer nip e, the toner image, which has been formed, and borne, on the peripheral surface of the rotating photosensitive member 1, is sequentially transferred from one end to the other by the electrostatic force, and the pressure in the transfer nip n.

Reference number 5 designates a fixing apparatus of a thermal fixation type or the like. After the transfer sheet P is fed into the transfer nip n and the toner image on the photosensitive member 1 side is transferred onto the transfer sheet P, the transfer sheet P is separated from the peripheral surface of the rotating photosensitive member 1, and is introduced into the fixing apparatus 5, in which the toner image is fixed to the transfer sheet P. Thereafter, the transfer sheet P is discharged as a print or a copy from the image forming apparatus.

Reference number 6 designates a cleaning apparatus, which removes the contaminants, such as toner particles, adhering to the peripheral surface of the photosensitive member 1 after the transfer of the toner image onto the transfer sheet P. After being cleaned by the cleaning apparatus 6, the peripheral surface of the photosensitive member 1 is used for the next cycle of image formation; the peripheral surface of the photosensitive member 1 is repeatedly used for image formation.

The printer in this embodiment is a cartridge type apparatus, which employs a replaceable type process cartridge 20 comprising four processing devices: the photosensitive member 1, the charge roller 2 as the contact type charging member, the developing apparatus 3, and the cleaning apparatus 6, which are replaceable all at once as the cartridge 20 is replaced. The combination of processing devices in the cartridge 20 does not need to be limited to the above combination; it is optional. Referential FIGS. 21 and 21 designate members for guiding and retaining the process cartridge 20. It should be noted here that the application of the present invention is not limited to cartridge type image forming apparatuses.

(2) Charge Roller 2 and Direct Charge Injection

Figure 2:
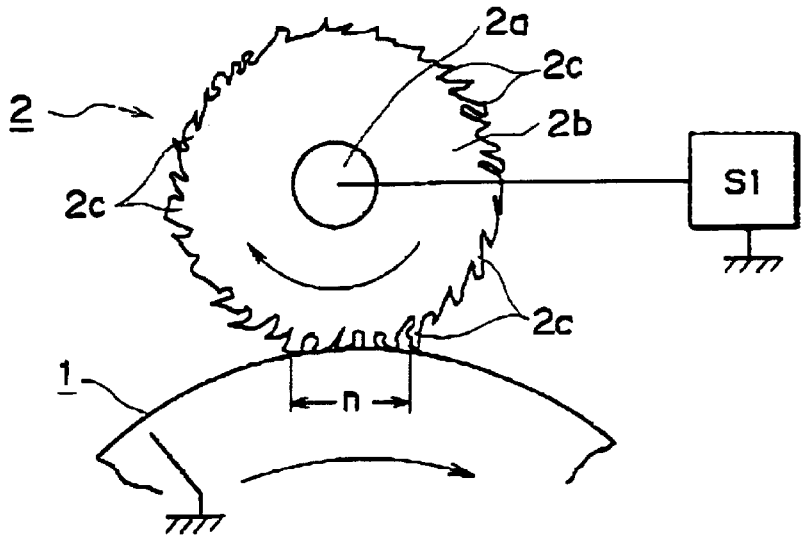
FIG. 2 is an enlarged schematic view of a charging roller portion.
Figure 3:
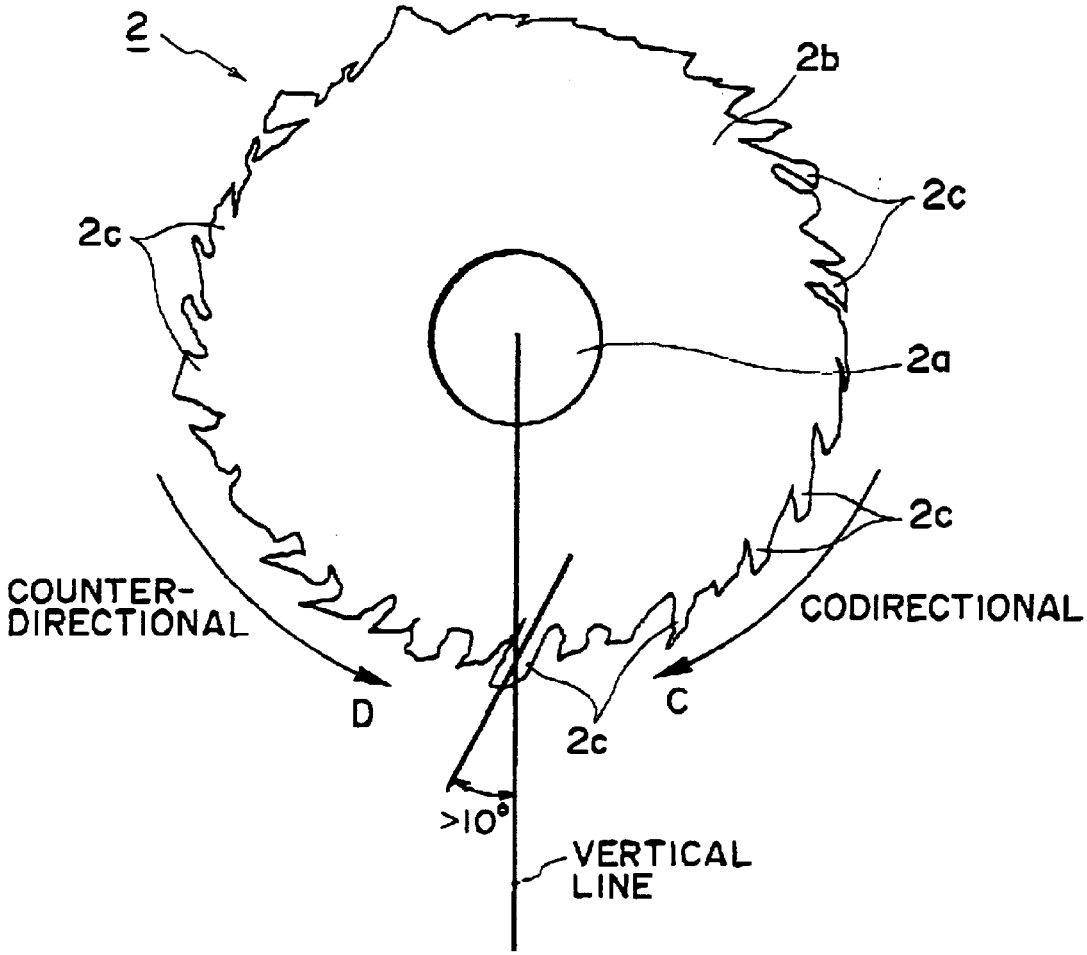
FIG. 3 is a further enlarged schematic cross-sectional view of a charging roller.

FIG. 2 is an enlarged schematic cross section of the charge roller 2 and its adjacencies illustrated in FIG. 1. FIG. 3 is a further enlarged cross section of the charge roller 2.

The charge roller 2 as the contact type charging member in this embodiment comprises the metallic core 2*a* and an elastic layer 2*b*. The metallic core 2*a* doubles as an electrode. The elastic layer 2*b* has a resistance value in a medium range, and its peripheral surface is provided with a large number of slant projections 2*c*, which are formed by grinding.

More specifically, the medium resistance layer 2*b* is composed of resin (for example, urethane), electrically conductive particles (for example, carbon black), sulfurizing agent, and the like, and is wound around the peripheral surface of the metallic core 2*a*, forming a roller, which is coaxial with the metallic core 2*a*. Thereafter, the peripheral surface of the medium resistance layer 2*b* is ground to produce an elastic, electrically conductive roller, as the charge roller 2, with a diameter of 12 mm and a length of 250 mm.

The peripheral surface of the charge roller 2 is provided with a large number of microscopic projections 2*c* slanted in the rotational direction of the charge roller 2, which are created due to the specific grinding method used to produce the charge roller 2. These projections 2*c* are approximately 10 μm in diameter and also in length. The angle of the projection 2*c* is desired to be 10 deg. or more relative to the line normal to the circumference of the cross section of the charge roller 2.

Figure 4:
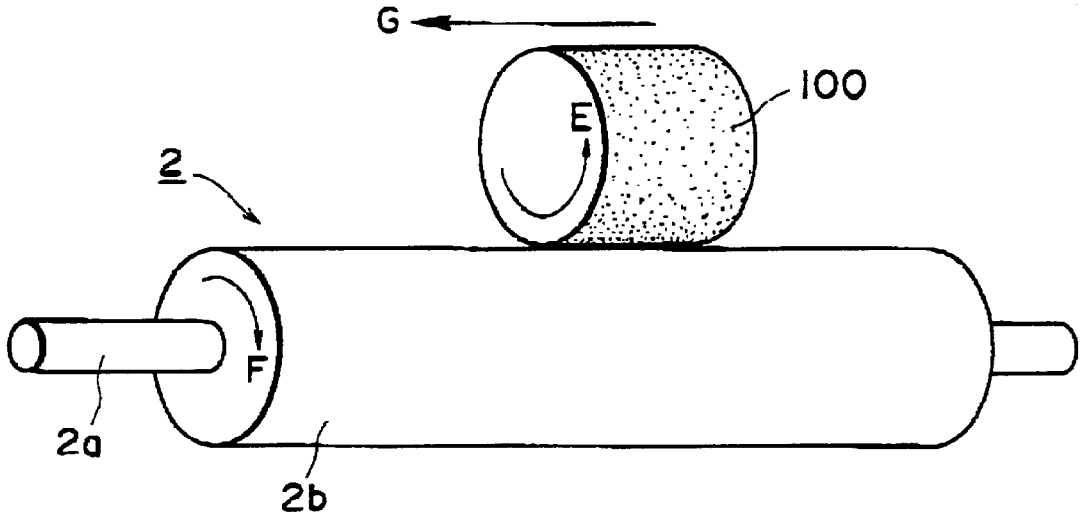
FIG. 4 illustrates an abrasion process manner for a charging roller.

FIG. 4 shows how the charge roller 4 is ground. The charge roller 2 is supported by unillustrated bearings, and is rotatively driven in the direction indicated by an arrow mark F at approximately 200 rpm. Reference number 100 designates a rotative grindstone, which is placed in contact with the peripheral surface of the charge roller 2, and is rotatively driven in the direction indicated by an arrow mark E at approximately 2000 rpm. As the grindstone 100 is moved along the peripheral surface of the charge roller 2 in the direction indicated by an arrow mark G from one end of the charge roller 2 to the other, the peripheral surface of the elastic medium resistance layer 2*b* of the charge roller 2 is ground.

Because the grindstone 100 is rotated substantially faster than the charge roller 2, only the rotational direction of the grindstone has to be taken into consideration as far as the direction in which the charge roller 2 is ground is concerned. The grindstone 100 is rotated in the arrow E direction in FIG. 4, and therefore, the peripheral surface of the charge roller 2 is given the microscopic projections slanted in the rotational direction of the charge roller 2 as the surface is ground.

Referring to FIG. 3, a direction C is the normal direction in which the charge roller 2 is rotated, that is, the same direction as the direction in which the projections 2*c* are slanted, and a direction D is the counter direction which is opposite to the direction in which the projections 2*c* are slanted. In the structure for grinding the charge roller 2, illustrated in FIG. 4, the arrow F direction is the normal direction, i.e. the extending direction of the projections.

The projections 2*c* on the peripheral surface of the photosensitive member 1 are desired to be 5–10 μm in diameter, 5–200 μm in length, and 10–200 projection/mm in density. These projections 2*c* can be formed by grinding. If their diameters are no more than 5 μm, the projections 2*c* lack resiliency, becoming ineffective when the charge roller 2 is rotated in such a direction that the extending direction of the projections 2*c* opposes the moving direction of the peripheral surface of the photosensitive member 1, whereas if their diameters are no less than 100 μm, the photosensitive member 1 is unsatisfactorily charged in terms of uniformity. If their lengths are no more than 5 μm, they are not effective as projections, whereas if their lengths are no less than 200 μm, the photosensitive member 1 is unsatisfactorily charged in terms of uniformity. Further, if projection density is no more than 10 projection/mm, the photosensitive member 1 is unsatisfactorily charged in terms of uniformity, whereas if the projection density is not less than 200 unit/mm, in other words, if the projection density is excessively large, it becomes difficult for the projections to move, or flex, and therefore, the effects of the projections become unsatisfactory.

When the electrical resistance of the charge roller 2 used in this embodiment was measured, it was 100 kΩ. As for the method used to measure the electrical resistance of the charge roller 2, the charge roller 2 was placed in contact with an aluminum 10 drum with a diameter of 30 mm so that an overall weight of 1 kg was applied to the metallic core 2*a* of the charge roller 2, and the electrical resistance of the charge roller 2 was measured while a voltage of 100 V was applied between the metallic core 2*a* and the aluminum drum.

It is very important that the charge roller 2 functions as an electrode. In other words, not only must the charge roller 2 be given a sufficient amount of elasticity so that a satisfactory state of contact can be established between a member or an object to be charged and the charge roller 2, but also an electrical resistance low enough to desirably charge a moving object must be given to the charge roller 2. On the other hand, the charge roller 2 must be able to prevent voltage leak, which occurs if defective portions, such as pin holes, are present in the object to be charged. When an electrophotographic photosensitive member is employed as the object to be charged, it is desirable, in order to provide the charge roller 2 with satisfactory charging performance and leak resistance, that the charge roller 2 has an electrical resistance in a range of $10^4$–$10^7$ Ω.

As for the hardness of the charge roller 2, if it is excessively low, the shape of the charge roller 2 becomes instable, and therefore, the state of contact between the charge roller 2 and the object to be charged becomes inferior, whereas if it is excessively high, not only is the charging nip n unsatisfactorily formed, but also the state of contact between the charge roller 2 and the object to be charged becomes interior in microscopic terms. Thus, the desirable hardness range for the charge roller 2 is 25 degrees to 50 degrees in ASKER-C scale.

As for the material for the elastic layer of the charge roller 2, elastic materials composed by dispersing electrically conductive substances such as carbon black or metallic oxides in EPDM, urethane, NBR, silicone rubber, IR, or the like to adjust electrical resistance, can be listed. The electrical resistance may be adjusted by using ion conductive material instead of dispersing the electrically conductive substances.

In this embodiment, the charge roller 2 is rotatively driven at a predetermined peripheral velocity, in the clockwise direction indicated by an arrow mark in FIG. 2, that is, in such a direction that the direction in which the peripheral surface of the charge roller 2 moves in the charging nip n becomes opposite (counter) to the direction in which the peripheral surface of the photosensitive member 1 moves in the charging nip n; the charge roller 2 is rotatively driven in contact with the peripheral surface of the photosensitive member 1, maintaining a velocity difference between the peripheral surfaces of the charge roller 2 and the photosensitive member 1.

Further, the charge roller 2 is rotated in contact with the peripheral surface of the photosensitive member 1 in such a direction that the extending direction of projections 2*c* on the peripheral surface of the charge roller 2 becomes opposite to the direction in which the peripheral surface of the photosensitive member 1 is moved That is, in this embodiment, the direction of the movement of the peripheral surface of the charge roller 2 in the charging nip n is opposite to the direction of the movement of the peripheral surface of the photosensitive member 1 in the charging nip n. Thus, the projections of the charge roller 2 are slanted in such a direction, as shown in FIG. 2, that the projections 2*c* extend in the downstream direction relative to the rotational direction of the charge roller 2 when they are not in contact with the peripheral surface of the photosensitive member 1. In other words, the charge roller 2 is rotated in such a direction that the extending direction of the projections 2*c* of the charge roller 2 becomes opposite to the direction in which the peripheral surface of the photosensitive member 1 is moved in the charging nip n.

Figure 5:
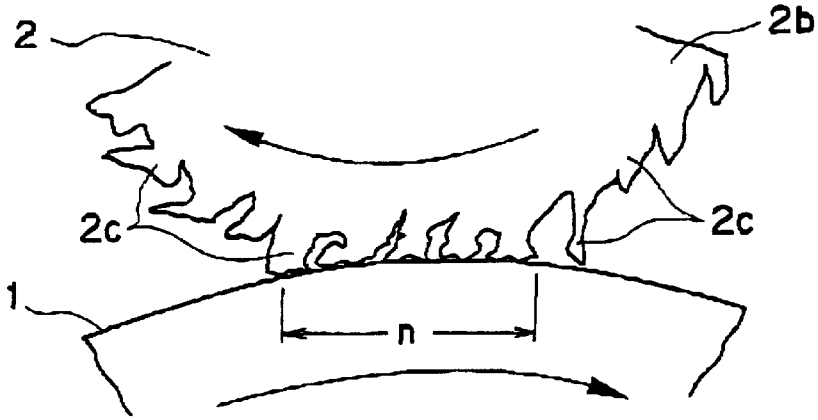
FIG. 5 is an enlarged schematic view of a charging nip in the case of counterdirectional contact sliding.

Thus, the peripheral surface of the photosensitive member 1 is rubbed by the projections 2*c* of the charge roller 2, which are slanted in the direction opposite to the moving direction of the peripheral surface of the photosensitive member 1, as shown in FIG. 5. Therefore, as the microscopic projections 2*c* on the peripheral surface of the charge roller 2 move into the charging nip n, that is, the contact area between the photosensitive member 1 and the charge roller 2, they deform into various shapes, as shown in FIG. 5, as they make contact with the peripheral surface of the photosensitive member 1. As a result, the state of contact between the charge roller 2 and the photosensitive member 1 is improved.

Figure 6:
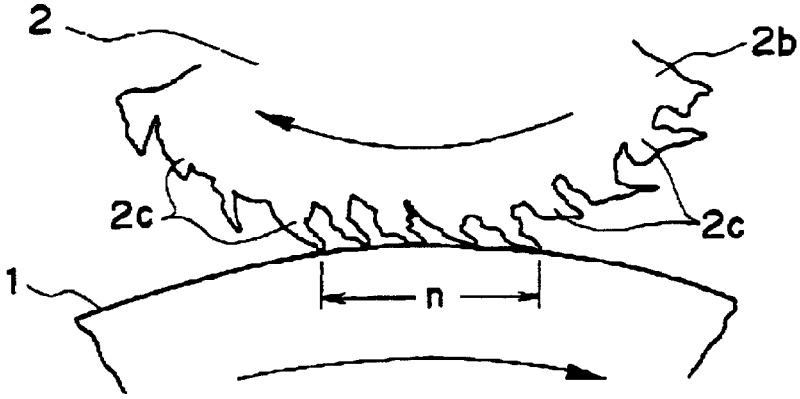
FIG. 6 is an enlarged schematic view in a charging nip in the case of a codirectional contact sliding.

In comparison, if the charge roller 2 is rotated in such a direction that the extending direction of the projections 2*c* coincides with the moving direction of the peripheral surface of the photosensitive member 1 in the charging nip n. the peripheral surface of the photosensitive member 1 is rubbed by the projections 2*c* of the charge roller 2, which are slanted in the same direction as the moving direction of the peripheral surface of the photosensitive member 1 as shown in FIG. 6. In this case, the microscopic projections 2*c* may be bent only slightly more in the charging nip n than outside the charging nip n, and their shapes remain substantially the same while the charge roller 2 is rotated. Therefore, the state of contact between the charge roller 2 and the photosensitive member 1 becomes less tight compared to the aforementioned state of contact between the charge roller 2 and the photosensitive member 1 in which the peripheral surface of the photosensitive member 1 is rubbed by the projections 2*c* slanted in the direction opposite to the moving direction of the peripheral surface of the photosensitive member 1. As a result, the photosensitive member 1 is sometimes insufficiently charged, on the areas which do not make satisfactory contact with the projections 2*c* of the charge roller 2.

In this embodiment, a DC voltage of −700 V is applied to the metallic core 2*a* of the charge roller 2, whereby the peripheral surface of the photosensitive member 1 is charged to a potential level substantially equal to the level of the voltage applied to the metallic core 2*a*, as shown by a bold line in FIG. 11. In other wards, in the case of the contact type charging process in this embodiment, the photosensitive member 1 is charged by the charge roller 2 dominantly through direct charge injection, because the projections 2*c* present on the peripheral surface of the charge roller 2 rub the peripheral surface of the photosensitive member 1, leaving no portion of the peripheral surface of the photosensitive member untouched, in the charging nip n between the charge roller 2, and the photosensitive member 1 as the object to be charged.

Assuming that in this embodiment, the peripheral velocity of the charge roller 2, or the velocity at which the peripheral surface of the charge roller 2 moves, is A mm/sec, and the peripheral velocity of the photosensitive member 1, or the velocity at which the peripheral surface of the photosensitive member 1 moves, is B mm/sec, if B has a positive value, then A has a negative value because the charge roller 2 and the photosensitive member 1 are rotated in such directions that their peripheral surfaces move in the opposite directions in the charging nip n. Therefore, $B-A>0$. Further, the image forming apparatus is structured so that the direction in which the projections 2*c* are slanted coincides with the upstream direction relative to the rotational direction of the photosensitive member 1, in other words, the peripheral surface of the photosensitive member 1 moves against the grain, or the extending direction of the projections, of the charge roller 2.

However, the structure of an image forming apparatus does not need to be limited to the above described one. For example, the charge roller 2 may be rotated in such a manner that the peripheral surfaces of the charge roller 2 and the photosensitive member 1 move in the same direction in the charging nip n. In such a case, an image forming apparatus is structured as described below.

That is, when the absolute value of A is smaller than that of B, in other words, when the peripheral velocity of the charge roller 2 is slower than that of the photosensitive member 1, $B-A>0$. In this case, the image forming apparatus is structured so that the direction in which the projections 2*c* are slanted coincides with the upstream direction in terms of the rotational direction of the photosensitive member 1.

On the other hand, when the absolute value of A is greater than that of B, in other words, when the peripheral velocity of the charge roller 2 is faster than that of the photosensitive member 1, $B-A<0$. In this case, the image forming apparatus is structured so that the direction in which the projections 2*a* are slanted coincides with the downstream direction in terms of the rotational direction of the photosensitive member 1.

With the above arrangement, the peripheral surface of the photosensitive member 1 moves against the grain of the peripheral surface of the charge roller 2 while the charge roller 2 and the photosensitive member 1 are driven.

When the photosensitive member 1 was charged using the above structure, the microscopic projections 2*c* on the peripheral surface of the charge roller 2 hung up on the microscopic irregularities on the peripheral surface of the photosensitive member 1 as they came in contact with the peripheral surface of the photosensitive member 1, becoming deformed. AS a result, the state of contact between the peripheral surfaces of the charge roller 2 and photosensitive member 1 became tighter and uniform, and therefore, the photosensitive member 1 was desirably charged in terms of uniformity.

As described above, in this embodiment, the elastic charge roller is rotated in contact with the photosensitive member, maintaining a peripheral velocity difference between them. Further, the peripheral surface of the charging member is provided with microscopic projections, which come in contact with the peripheral surface of the photosensitive member in such a manner that the direction in which the projections are slanted opposes the rotational direction of the photosensitive member 1. Therefore, the state of contact between the charging member and the photosensitive member is improved to a level high enough for electrical charge to be directly and uniformly injected into the peripheral surface of the photosensitive member.

Embodiment 2

In this embodiment, the projections 2*c* are formed on the charge roller 2 using a simpler method.

That is, the projections slanted in the rotational direction of the charge roller 2 are formed by providing the internal surface of a charge roller mold with such indentations that produce the above described projections In order to form an elastic material with adjusted electrical resistance, or the material for the elastic layer 2*b* of the charge roller 2, into a predetermined shape of the charge roller 2, the material is placed in a metallic mold, the internal surface of which has been form so as to produce, on the peripheral surface of the elastic layer 2*b*, projections slanted in the rotational direction of the peripheral surface of the elastic layer 2*b*.

In this embodiment, the charge roller 2 was formed using a metallic mold, the internal surface of which is provided with such indentations that produce projections which are 10 $\mu$m in diameter, 10 $\mu$m in length, and slanted 10 deg. or more from the line normal to the circumference of the cross section of the elastic layer 2*b*. With the use of this metallic mold, it was possible to produce a charge roller with desired surface properties, that is, a charge roller, the peripheral surface of which is provided with projections slanted in the rotational direction of the peripheral surface of the charge rollers.

When a charge roller is manufactured using the method in this embodiment, the grinding process becomes unnecessary, and therefore, manufacturing steps can be simplified.

Embodiment 3

In this embodiment, the electrical resistance of an object to be charged is adjusted so that the object can be more reliably charged in terms of the uniformity of charge. More specifically, the photosensitive member 1 as the object to be charged in Embodiment 1 or 2 is provided with a charge injection layer, which constitutes the surface layer, to adjust the electrical resistance of the peripheral surface of the photosensitive member 1 so that the photosensitive member 1 can be more reliably and uniformly charged.

Figure 7:
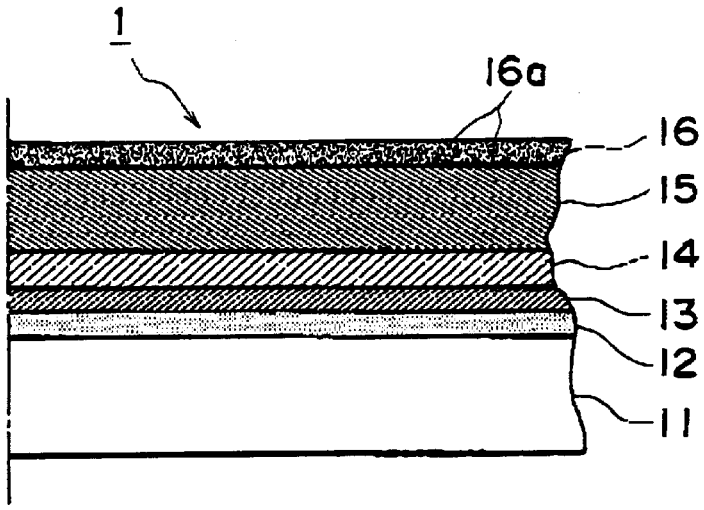
FIG. 7 is a schematic view of layer structure of a photosensitive member provided with a charge injection layer.

FIG. 7 is a schematic vertical section of the peripheral portion of the photosensitive member 1 with a charge injection layer 16 as the surface layer, and depicts the laminar structure of this photosensitive member 1. In this embodiment, the charging performance is improved by coating the charge injection layer 16 on the peripheral surface of an ordinary organic photosensitive drum which comprises an aluminum base member 11 in the form of a drum, and four layers: an undercoat layer 12, a positive charge injection prevention layer 13, a charge generation layer 14, and a charge transfer layer 15, which are coated on the base member 11 in this order from the bottom.

The material for the charge injection layer 16 is composed by dispersing ultramicroscopic $SnO_2$ particles 16*a* (0.03 $\mu$m in diameter) as electrically conductive particles (electrically conductive filler), lubricant such as tetrafluoroethylene (Teflon), polymerization initiating agent, and the like, into photo-curing acrylic resin as binder. This material is coated and photocured into a thin film, that is, the charge injection layer 16.

In the case of the printer in this embodiment, the projections on the peripheral surface of the charge roller improved the state of contact between the charge roller 2 and the photosensitive member 1 as described in Embodiment 1, and in addition, the presence of the charge injection layer 16, which constituted the surface layer of the photosensitive member 1, improved the efficiency with which electrical charge is directly injected into the photosensitive member 1. Therefore, the photosensitive member 1 was uniformly charged even after 1000 copies were printed.

The most essential aspect of the charge injection layer 16 is related to the electrical resistance of the surface layer of the photosensitive member 1. In a charging system in which electrical charge is directly injected, reduction in the electrical resistance of an object to be charged increases the efficiency with which electrical charge is given to the object. However, when an object to be charged is an image bearing member (photosensitive member), the object must be able to hold an electrostatic latent image for a predetermined length of time. Thus, the volumetric resistance value of the charge injection layer 16 should be in a range of $1\times10^{9}$–$1\times10^{14}$ ($\Omega$.cm).

It should be noted here that even if a photosensitive member is not provided with a charge injection layer such as the charge injection layer 16 in this embodiment, effects similar to those in this embodiment can be obtained as long as the electrical resistance of the charge transfer layer 15 of the photosensitive member is within the aforementioned electrical resistance range.

Further, the effects similar to those in this embodiment can be obtained with the use of an amorphous silicon based photosensitive member, the surface layer of which has a volumetric resistivity of approximately $10^{13}$ $\Omega$.cm.

As described above, in this embodiment, a photosensitive member is provided with a charge injection layer, which constitutes the surface layer. Therefore, electrical charge can be directly and reliably injected into the photosensitive member 1 even after the charging apparatus in this embodiment is kept in service for a long time.

Embodiment 4

As is evident from the above description, even when a simple elastic member is used as the charging member for a contact type charging system, electrical charge can be directly, uniformly, and reliably injected for a long period of service by employing the following measures.

1. Rotating a charging member in contact with an object to be charged, maintaining a peripheral velocity difference between them.

2. Providing the peripheral surface of the charging member with a large number of projections slanted in the rotational direction of the peripheral surface of the charging member.

3. Structuring an image forming apparatus so that the charging member and the object to be charged are rotated in contact with each other, with the peripheral surface of the object to be charged moving against the grain of the slanted projections on the peripheral surface of the charging member.

In this embodiment, the following measure is added to the above listed measures 1, 2 and 3.

4. Placing electrically conductive particles at least between the interface, i.e. contact area, between the charging member and the object to be charged.

With the addition of this measure, the rotation of the charging member is stabilized, and the size of the contact area between the charging member and the object to be charged increases, improving the state of contact, and therefore, electrical charged can be directly injected into the object to be charged, more reliably and uniformly.

The electrically conductive particles are such particles that are intended for promoting or enhancing the performance of the charge roller in charging the object. The object is charged through the contact type charging process, with the presence of the charging-promoting particles or charging performance enhancing particles in the nip portion between the object to be charged and the contact type charging member.

With the presence of these charging performance enhancing particles, the charging member and the object to be charged can be more easily rotated in contact with each other while maintaining a peripheral velocity difference in the nip portion between the object to be charged and the charging member, because the charging performance enhancing particles serve as lubricant. At the same time, the charging member makes tighter contact with the object to be charged, through the charging performance enhancing particles; the charging performance enhancing particles present in the nip between the contact type charging member and the object to be charged, rub the peripheral surface of the object to charged, leaving no portion of the peripheral surface of the photosensitive member untouched. Thus, the presence of the charging performance enhancing particles enables, in coordination with the function of the aforementioned slanted projections, electrical charge to be directly injected, more reliably and uniformly.

This embodiment is such an embodiment that employs both the slanted projections and the charging performance enhancing particles.

Figure 8:
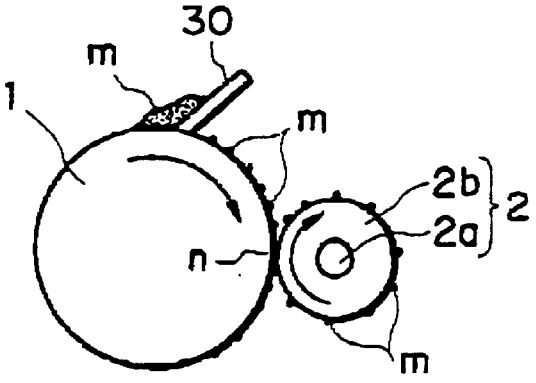
FIG. 8 is a schematic view of a charging device using charging-promotion particles.

Referring to FIG. 8, a reference number 1 designates an object to be charged, for example, an electrophotographic photosensitive member of a rotational drum type, and a referential FIG. 2 designates a charge roller as a contact type charging member. Reference number 30 designates a regulating blade as a means for coating the charging performance enhancing particles, and a referential character m designates a charging performance enhancing particle.

a. Charge Roller 2

The charge roller 2 comprises an elastic layer like those of the charge rollers in Embodiment 1 or 2. Its peripheral surface is provided with a large number of projections slanted in the rotational direction of the peripheral surface of the roller. The charge roller 2 is rotated in contact with the photosensitive member 1, maintaining a predetermined peripheral velocity difference from the photosensitive member 1, with the peripheral surface of the photosensitive member 1 moving against the grain, or the direction of the slanted projections, of the charge roller 2, to directly inject electrical charge into the photosensitive member 1.

b. Charging Performance Enhancing Particles m

The charging performance enhancing particles m employed in this embodiment are electrically conductive zinc oxide particles which have a specific resistance of $10^6$ Ω.cm and an average particle diameter of 3 μm.

The material for the charging performance enhancing particles m does not need to be limited to zinc oxide; many other electrically conductive particles may be used, for example, electrically conductive nonorganic particles such as metallic oxides other than zinc oxide, or mixtures between the electrically conductive nonorganic particles and organic particles.

In order for electrical charge to be transferred through the particles, the specific resistance of the particles is desired to be no more than $10^{12}$ Ω.cm, preferably no more than $10^{10}$ Ω.cm. The specific resistance of the particles is obtained by measuring the particle size with the use of the tablet method, and then normalizing the results of the measurement. More specifically, approximately 0.5 g of a particle sample was placed in a cylinder with a cross section area of 2.26 $cm^2$. Then, the resistance value of the particle sample was measured while applying a pressure of 15 kg and a voltage of 100 V through the top and bottom electrodes. Then, the specific resistance of the particle is obtained by normalizing the thus measured resistance value.

In order to prevent the charging performance enhancing particles from interfering with the exposing process, they are desired to be nearly white or transparent. Also they are desired to be nonmagnetic.

Further, in order to uniformly charge the photosensitive member 1, the diameter of the charging performance enhancing particle is desired to be no more than 50 μm. In order to prevent the charging performance enhancing particles from becoming unstable, the smallest diameter for the charging performance enhancing particle should be no less than 10 nm. Further, the diameter of the charging performance enhancing particle is desired to be no greater than that of a picture element.

When the charging performance enhancing particles were constituted of aggregates, the diameter of the charging performance enhancing particle was defined as the average diameter of the aggregates, and was measured in the following manner. That is, no less than 100 aggregates were picked, and their maximum chord lengths in the horizontal direction were measured, using an optical or electron microscope. Then, volumetric particle size distribution was calculated from the results of the measurement. Then, 50% average particle diameter obtained from the distribution was used as the average diameter of the charging performance enhancing particle in the aggregate form.

c. Charging Performance Enhancing Particle Coating Means 30

In this embodiment, in order to uniformly supply the charging nip n between the charge roller 2 and the photosensitive member 1 with the charging performance enhancing particles m, and hold them there, the charging performance enhancing particle coating means 30 is disposed on the upstream side of the charging nip n in terms of the rotational direction of the photosensitive member 1.

The charging performance enhancing particle coating means 30 in this embodiment is a regulating blade placed in contact with the photosensitive member 1, and is structured to hold the charging performance enhancing particles m between the photosensitive member 1 and the regulating blade 30.

With this structural arrangement, a predetermined amount of the charging performance enhancing particles m is coated on the peripheral surface of the photosensitive member 1 as the photosensitive member 1 is rotated, and is carried to the charging nip n to supply the charging nip n with the charging performance enhancing particles m. Then, in the charging nip n, the charging performance enhancing particles m are uniformly coated onto the charge roller 2, or uniformly distributed across the charging nip n.

The charging performance enhancing particle supplying structure does not need to be limited to the one described above; much simpler structures or methods may be employed. For example, a method, in which a foamed member, or a fur brush, impregnated with the charging performance enhancing particles m is placed in contact with the object 1 to be charged or the charge roller 2, may be employed.

d. Direct Charge Injection

The photosensitive member 1 is in the form of a drum with a diameter of 30 mm, and is rotated at a constant peripheral velocity of 50 mm/sec.

As the photosensitive member 1 is rotated, the charging performance enhancing particles m are coated on the peripheral surface of the photosensitive member 1 by the regulating blade 30, and reach the charging nip n.

The charge roller 2 is driven at approximately 80 rpm so that the peripheral surfaces of the charge roller 2 and the photosensitive member 1 move at a constant velocity in the opposite directions in the charging nip n.

Figure 9:
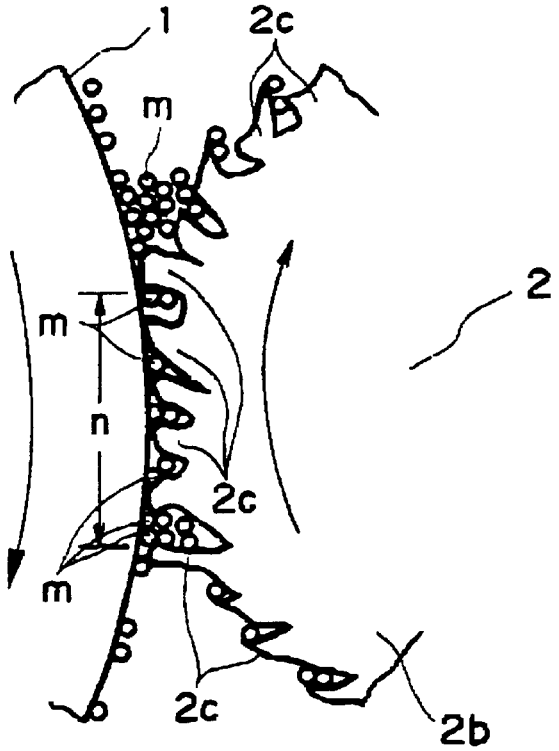
FIG. 9 is an enlarged schematic view of a charging nip.

Thus, in this embodiment, the microscopic projections 2*c* on the peripheral surface of the charge roller 2 make contact with the peripheral surface of the photosensitive member 1, deforming in various shapes, in the charging nip n, and at the same time, the charging performance enhancing particles m coated on the photosensitive member 1 are easily impregnated into the peripheral surface of the charge roller 2 due to the presence of the microscopic projections 2*c* on the peripheral surface of the charge roller 2, as shown in FIG. 9 which is an enlarged schematic section of the charging nip n. In other words, the deformation of the microscopic projections 2*c* present on the peripheral surface of the charge roller 2, and the presence of the charging performance enhancing particles m, in the charging nip n, improve the state of contact between the charge roller 2 and the photosensitive member 1.

To the metallic core 2*a* of the charge roller 2, a DC voltage of −700 V is applied, whereby the peripheral surface of the photosensitive member 1 is charged to a potential level equal to the level of the voltage applied to the metallic core 2*a*.

In other words, in the case of the contact type charging process in this embodiment, a process of direct charge injection plays the dominant role. That is, electrical charge is directly injected as the projections 2*c* on the peripheral surface of the charge roller 2 and the charging performance enhancing particles m present in the charging nip n between the charge roller 2 and the photosensitive member 1 rub the peripheral surface of the photosensitive member 1, leaving no portion of the peripheral surface of the photosensitive member untouched.

When the photosensitive member 1 was charged by the charge roller 2 with the structure described above, the microscopic projections 2*c* on the peripheral surface of the charge roller 2 hung up on the microscopic irregularities on the peripheral surface of the photosensitive member 1, deforming in various shapes, as they came in contact with the peripheral surface of the photosensitive member 1. Further, the presence of the projections 2*c* on the peripheral surface of the charge roller 2 made it easier for the charging performance enhancing particles m to be picked up by the peripheral surface of the charge roller 2. As a result, the peripheral surface of the charge roller 2 made contact with the peripheral surface of the photosensitive member 1, more uniformly and with higher density. Consequently, the photosensitive member 1 was desirably charged in terms of the uniformity of charge.

According to an experiment, a desirable amount of the charging performance enhancing particles m in the charging nip n was $10^3$–$5\times10^5$ particle/mm$^2$.

Next, the method for measuring the amount of the charging performance enhancing Particles m in the charging nip n will be described. It is desirable that the amount of the charging performance enhancing particles m in the charging nip n is directly measured. However, the majority of the charging performance enhancing particles m present on the peripheral surface of the photosensitive member 1 are stripped by the peripheral surface of the charge roller 2, which is moving in the direction opposite to the direction of the movement of the peripheral surface of the photosensitive member 1, before they enter the charging nip n. Therefore, in the case of the present invention, the amount of the charging performance enhancing particles m in the charging nip n was defined as the amount of the charging performance enhancing particles m at a location immediately before the charging nip n. More specifically, the rotations of the photosensitive member 1 and the charge roller 2 were stopped, and the charge bias was not applied. Then, the peripheral surface of the charge roller 2 was photographed with a video-microscope (Olympus OVM 1000N) and a digital still recorder (Deltis SR-3100). Further, the charge roller 2 was placed in contact with a piece of slide glass under the same condition as it was placed in contact with the photosensitive member 1, and no less than 10 spots across the contact surface between the charge roller 2 and the slide glass were photographed from behind the slide glass by the video-microscope fitted with an object lens with 1000 times magnification. In order to separate charging performance enhancing particle containing cells from the thus obtained digital image, the digital image was processed using a given threshold to produce a binary image, and the number of the particle containing cells was counted using a given image processing software.

Embodiment 5

Figure 10:
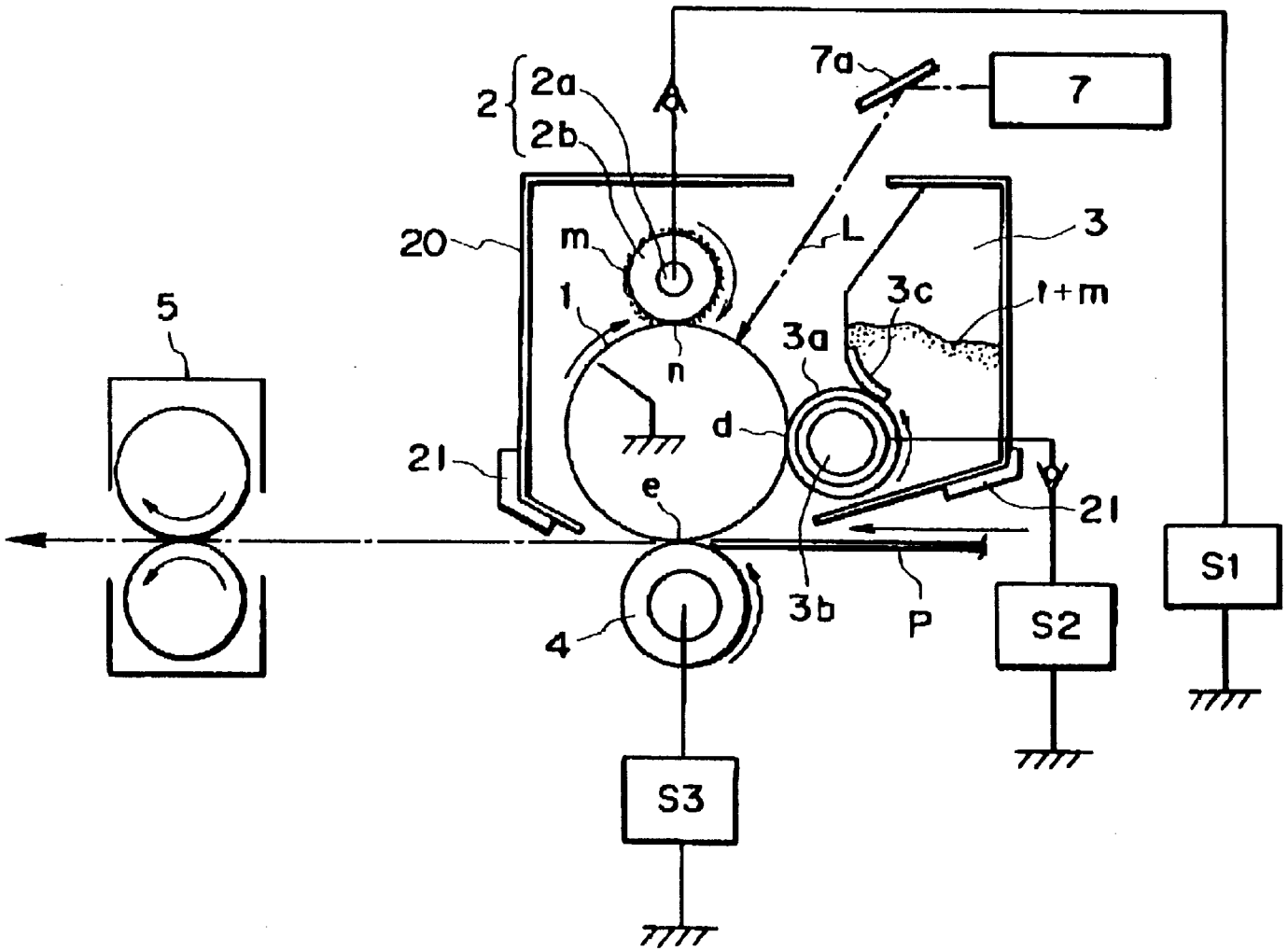
FIG. 10 is a schematic view of a cleanerless type image forming apparatus.

In this embodiment, the present invention is embodied in the form of a cleanerless image forming apparatus. FIG. 10 is a schematic section of the image forming apparatus in this embodiment, and depicts the general structure thereof. The printer in this embodiment is substantially identical to the printer in Embodiment 1 except that this printer lacks the cleaning apparatus 6. The structural members or portions which are the same as those in the printer in Embodiment 1 are designated with the same referential codes as those used in Embodiment 1 to omit the repetition of the same descriptions.

a. Charge Roller 2

The charge roller 2 in this embodiment comprises an elastic layer 2*b* which is composed of foamed elastic material, and has intermediate electrical resistance. The peripheral surface of the elastic layer 2*b* is provided with a large number of slant projections 2*c* formed by grinding the surface. Just as in Embodiment 1 or 2, electrical charge is directly injected into the photosensitive member 1 by rotating the charge roller 2 and photosensitive member 1 in such a manner that the peripheral surface of the photosensitive member 1 moves against the grain, or the extending direction of the slanted projections 2*c*, of the peripheral surface of the charge roller 2, maintaining a peripheral velocity difference between the charge roller 2 and photosensitive member 1.

The foamed elastic material for the medium resistance layer 2*b* is an elastic material created by dispersing an electrically conductive substance such as carbon black or metallic oxides into, for example, EPDM, urethane, NBR, silicone rubber, IR, or the like to adjust electrical resistance, and then, causing the compound to form.

The observation of the surface of the foamed elastic layer 2*b* with the intermediate resistance after grinding, reveals that the slanted projections 2*c* in this embodiment are longer than those of the elastic layer (not foamed) of the charge roller 2 in Embodiment 1, being 10 μm in diameter and several times 10 μm in length.

Using the above described foamed elastic material as the material for the elastic layer for the charge roller 2 further improves the charging performance of the charge roller 2, and at the same time, enables even a cleanerless image forming apparatus to output desirable images which do not suffer from the effects of the "residual toner particles", or the toner particles that remain on the photosensitive member 1 after image transfer. More specifically, using the above described foamed elastic material makes the microscopic projection 2*c* on the peripheral surface of the foamed elastic layer of the charge roller 2 slightly longer than using the material which has not been foamed. The thus created slightly longer projections 2*c* pick up, or stir, the substance (in this case, toner particles remaining after image transfer, or charging performance enhancing particles) adhering to the peripheral surface of the photosensitive member 1, more effectively, that is, by a substantially larger amount, than the projections in Embodiment 1 or 2, as the peripheral surface of the photosensitive member 1 is moved against the grain, or the extending direction of the projections 2*c*, that is, as the projections 2*c* are moved in such a manner that they hung up on, or collide with, the irregularities on the peripheral surface of the photosensitive member 1.

In order to temporarily recover, or evenly disperse, the residual toner particles, it is desirable that the charge roller 2 is rotatively driven in such a manner that the peripheral surface of the charge roller 2 moves in the direction opposite to the moving direction of the peripheral surface of the photosensitive member 1.

b. Charging performance Enhancing Particles m

In this embodiment, the charging performance enhancing particles m are coated on the peripheral surface of the charge roller 2 in advance, so that the photosensitive member 1 can be desirably charged from the very start of each charging process.

Further, the charging performance enhancing particles m are mixed by two parts in weight in the single component magnetic toner t, that is, the developer, stored in the developing apparatus 3. The charging performance enhancing particles m mixed in the developer t adhere to the peripheral surface of the photosensitive member 1 when an electrostatic latent image on the peripheral surface of the photosensitive member 1 is developed, and then are supplied to the charging nip n by being carried to the charging nip n, through the transfer nip e, as the photosensitive member 1 is rotated.

The charging performance enhancing particles m employed in this embodiment are electrically conductive zinc oxide particles with a diameter of 3 μm. They are desired to be nearly white or colorless so that they do not interfere with an exposing process for forming a latent image, in particular, when they are used for enhancing the efficiency with which a photosensitive member is charged. Further, when they are used to enhance color recording, they are desired to be nearly colorless or white, in consideration of the fact that the charging performance enhancing particles m might be transferred onto a recording sheet P from a photosensitive member. Further, in order to prevent the charging performance enhancing particles m from scattering the light when a photosensitive member is exposed for latent image formation, the size of the charging performance enhancing particle m is desired to be smaller than the size of a picture element.

c. Direct Charge Injection

The photosensitive member 1 is in the form of a drum with a diameter of 30 mm, and is rotated at a constant peripheral velocity of 50 mm/sec. The charge roller 2 is driven at approximately 80 rpm, in such a manner that the peripheral surfaces of the charge roller 2 and the photosensitive member 1 move at constant velocities in the opposite directions in the charging nip n. To the metallic core 2*a* of the charge roller 2, a DC voltage of −700 V is applied.

Also in this embodiment, the microscopic projections 2*c* on the peripheral surface of the charge roller 2 make contact with the peripheral surface of the photosensitive member 1, deforming in various shapes, in the charging nip n, and as they come in contact with the peripheral surface of the photosensitive member 1, the charging performance enhancing particles m present in the charging nip n are impregnated into the peripheral surface of the charge roller 2 by the microscopic projections 2*c*. This deformation of the microscopic projections 2*c* on the peripheral surface of the charge roller 2, and the presence of the charging performance enhancing particles m in the charging nip a, combine to improve the state of contact between the charge roller 2 and the photosensitive member 1 as they do in Embodiment 4.

With the above arrangement, the peripheral surface of the photosensitive member 1 is charged to a potential level equal to the level of the voltage applied to the charge roller 2. That is, in the case of the contact type charging system in this embodiment, the direct charge injection process plays the dominant role; the projections 2*c* on the peripheral surface of the charge roller 2, and the charging performance enhancing particles m present in the charging nip n between the charge roller 2 and the photosensitive member 1 combined to tub the peripheral surface of the photosensitive member 1, leaving no spot on the peripheral surface of the photosensitive member 1, untouched, to directly inject charge into the photosensitive member 1.

d. Cleanerless System

As described above, the rotating photosensitive member 1 is charged by the charge roller 2, to a substantially the same potential level as the level of the voltage applied to the charge roller 2, through the direct charge injection process. Then, the charged surface of the photosensitive member 1 is exposed to a scanning laser beam L from a laser beam scanner 7, and as a result, an electrostatic latent image correspondent to a desired print pattern is formed on the peripheral surface of the rotating photosensitive member 1.

Then, the electrostatic latent image is developed in reverse into a toner image by the developing apparatus 3, and the toner image is sequentially transferred from one end to the other onto a transfer sheet P, as recording medium, delivered with a predetermined timing to the transfer nip e from an unillustrated sheet feeding section.

After receiving the toner image in the transfer nip e, the transfer sheet P is separated from the peripheral surface of the rotating photosensitive member 1, and is introduced into a fixing apparatus 5, in which the toner image is permanently fixed to the transfer sheet P. Thereafter, the transfer sheet P is discharged as a print or a copy from the image forming apparatus.

In the case of a cleanerless image forming apparatus, the residual toner particles (residual developer), or the toner particles remaining on the peripheral surface of the photosensitive member 1 after toner image transfer, are carried virtually undisturbed to the charging nip n between the photosensitive member 1 and the charge roller 2 as the photosensitive member 1 is rotated. In the charging nip n, the residual toner particles are stirred by the projections 2*c* on the peripheral surface of the charge roller 2, the grain, or the extending direction, of which is against the moving direction of the peripheral surface of the photosensitive member 1, and then, adhere to, or are impregnated into, the peripheral surface of the charge roller 2 (the residual toner particles are temporarily recovered by the charge roller 2) Because the toner particles are generally insulator, their adhesion to, or impregnation into, the charge roller 2 is one of the factors that are responsible for improper charging of the photosensitive member 1.

However, in this embodiment, the charging performance enhancing particles m are present in the charging nip n between the charge roller 2 and the photosensitive member 1, by which the state of contact between the charge roller 2 and the photosensitive member 1 is kept tight enough to maintain desirable contact resistance between the charge roller 2 and the photosensitive member 1. Therefore, in spite of the contamination of the charge roller 2 by the residual toner particles, charge can be directly injected. In other words, electrical charge can be directly and continuously injected into the photosensitive member 1 with the application of relatively low voltage to the charge roller 2, thus generating practically no ozone, to uniformly charge the photosensitive member 1.

The residual toner particles which adhere to, or are impregnated into the charge roller 2, are electrically discharged from the charge roller 2 gradually onto the photosensitive member 1. Since the charge roller 2 bears the charging performance enhancing particles m in this embodiment, the force with which the residual toner particles adhere to the charge roller 2 is reduced, improving the efficiency with which the residual toner particles are discharged from the charge roller 2 onto the photosensitive member 1.

After being discharged onto the photosensitive member 1 from the charge roller 2, the residual toner particles arrive at the developing station d as the peripheral surface of the photosensitive member 1 is rotatively moved. Then, they are recovered by the developing apparatus 3 (cleaning process carried out at the same time and location), or used for the developing process (toner recycling).

As described previously, in the process in which both cleaning and image development occur at the same time and location, the photosensitive member 1 on which the toner particles are remaining after toner image transfer is charged without removal of the residual toner particles, and exposed to form a latent image on the photosensitive member 1. Then, when the latent image is developed, the residual toner particles are recovered by the fog prevention bias Vback, that is, the difference between the level of the DC voltage applied to the developing apparatus 3, and the surface potential level of the photosensitive member 1, in the development apparatus 3. When the reversal development process is employed as it is by the printer in this embodiment, the cleaning-developing process is carried out by the functions of an electric field for recovering the residual toner particles onto a developing sleeve from the "dark" regions of the latent image on the peripheral surface of the photosensitive member 1, and an electrical field for adhering the toner particles to the "light" regions of the latent image on the peripheral surface of the photosensitive member 1, which are generated at the same time and location.

Through repetition of the above described processes, electrical charge is directly injected into the photosensitive member 1, while recycling the toner, throughout the long service life of the apparatus. The residual toner particles and the charging performance enhancing particles are stirred, or impregnated into the peripheral surface of the charge roller 2, and therefore, flawless images, which do not suffer from the ghosts attributable to the residual toner particles, can be outputted.

When images were outputted by the image forming apparatus in this embodiment, even the 3000th copy did not suffer from the ghosts attributable to the cleanerless structure of the apparatus; the charging performance of the apparatus remained stable. Further, when the photosensitive member 1 employed in this embodiment was replaced with-the photosensitive member with the charge injection layer 16 described in Embodiment 2 (FIG. 7), even the image printed on the 5000th recording sheet was desirable.

In this embodiment, the residual toner particles are satisfactorily recovered, or stirred, by the charge roller 2 due to the presence of the projections 2*c* on the peripheral surface of the charge roller 2, and in addition, the projections 2*c* and the charging performance enhancing particles m make the state of contact between the charge roller 2 and the photosensitive member 1 tight for desirably charging the photosensitive member 1. Therefore, the image forming apparatus can output desirable images which do not suffer from flaws attributable to the passing of the residual toner particles through the charging nip n, or attributable to the improper charging of the photosensitive member 1, in spite of the fact that the image forming apparatus is of a cleanerless type.

The charging performance enhancing particles m mixed into the single component magnetic toner t, as the developer, stored in the developing apparatus 3, adhere to the peripheral surface of the photosensitive member 1 during the development of an electrostatic latent image formed on the peripheral surface of the photosensitive member 1, and are supplied to the charging nip n by being carried to the charging nip n, through the transfer nip e, as the photosensitive member 1 is rotated.

More specifically, the toner image developed on the photosensitive member 1 actively transfers onto the transfer sheet P by being attracted toward the transfer sheet P by the transfer bias, in the transfer nip e, whereas the charging performance enhancing particles m, having adhered to the peripheral surface of the photosensitive member 1 during the latent image development on the peripheral surface of the photosensitive member 1 by the developing apparatus 3, do not actively transfer onto the transfer sheet P side, remaining adhered to the peripheral surface of the photosensitive member 1, practically undisturbed, because the charging performance enhancing particles m have a low electrical resistance value. Then, the charging performance enhancing particles m remaining on the peripheral surface of the photosensitive member 1 are supplied to the charging nip n by being carried to the charging nip n, through the transfer nip e, as the peripheral surface of the photosensitive member 1 rotationally moves.

As is evident from the above description, in this embodiment, the peripheral surface of the charge roller 2 is provided with the charging performance enhancing particles m, which are coated in advance on the peripheral surface of the charge roller 2, and also the charging performance enhancing particles m mixed in the developer t in the developing apparatus 3 are supplied to the charge roller 2 through the developing and transferring processes. Therefore, even when the residual toner particles adhered to, or are impregnated into, the peripheral surface of the charge roller 2, the state of contact between the charge roller 2 and the photosensitive member 1 is kept tight enough to maintain desirable contact resistance between the charge roller 2 and the photosensitive member 1 for directly injecting electrical charge into the photosensitive member 1. Further, the charging performance enhancing particles m are continuously supplied from the developing apparatus 3, and therefore, even if the charging performance enhancing particles m fall off the charge roller 2, the desirable charging performance can be maintained. In other words, the desirable charging performance can be maintained from the very beginning through the long service life of the image forming apparatus.

Embodiment 6

Figure 12:
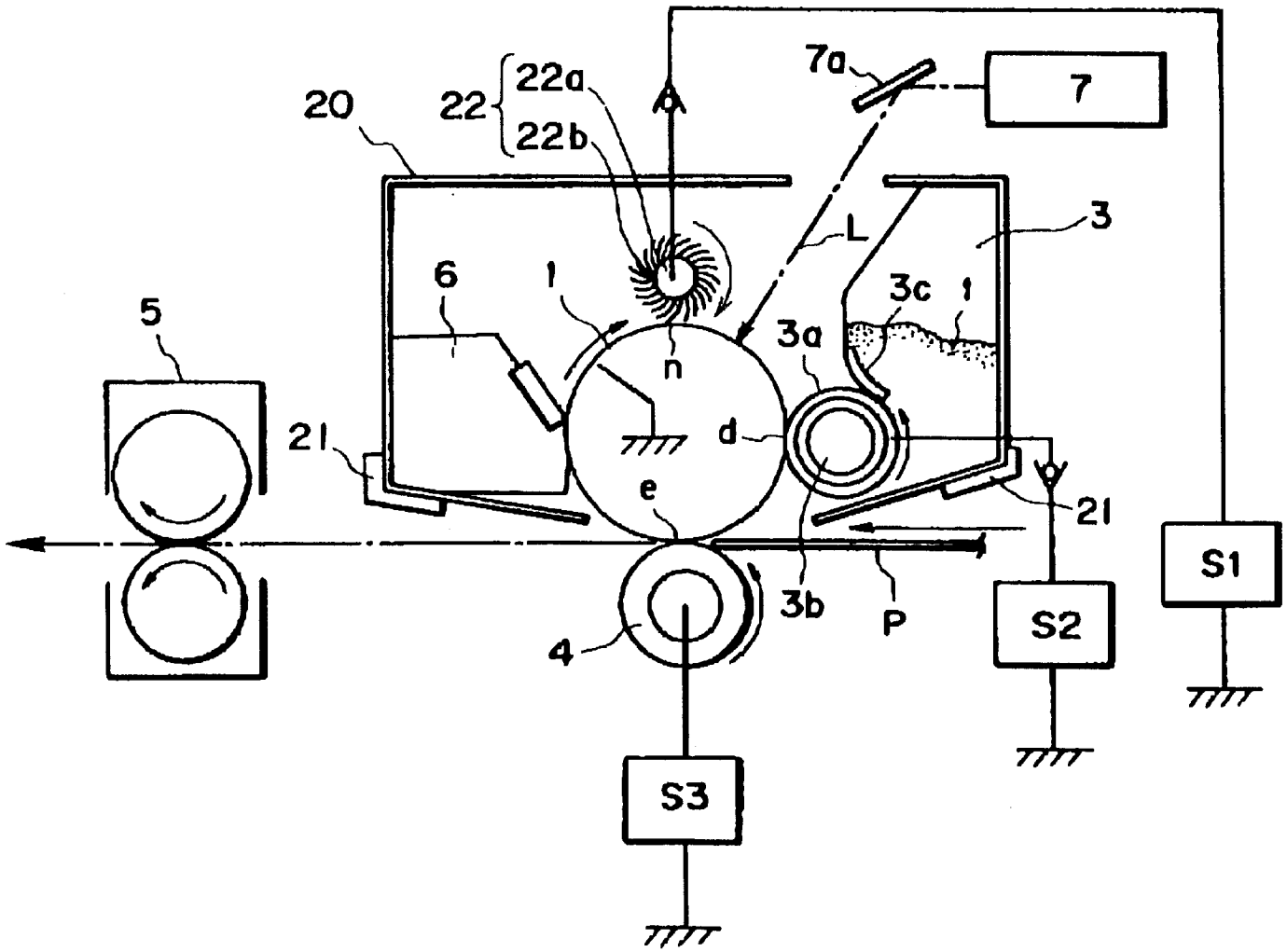
FIG. 12 is a schematic view of an image forming apparatus according to Embodiment 6.

Referring to FIG. 12, in this embodiment, a fur brush type charge roller is employed as the charging member, in place of the charge roller described in Embodiment 1. The other features of the image forming apparatus in this embodiment are the same as those described in Embodiment 1, and therefore, their descriptions will be omitted.

(2) Fur Brush Roller 22 and Direct Charge Injection

Figure 13:
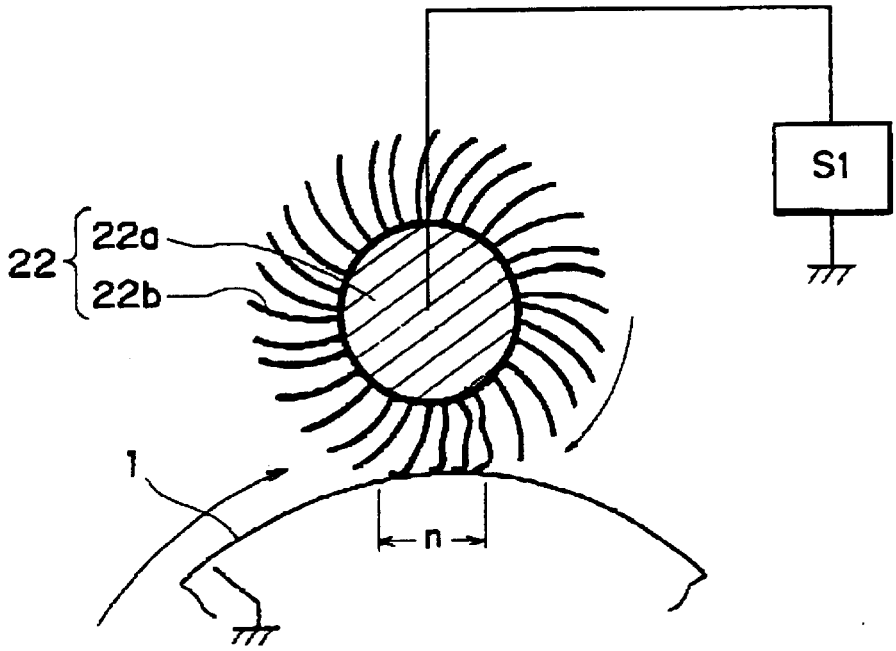
FIG. 13 is an enlarged schematic view of a furbrush roller portion.
Figure 14:
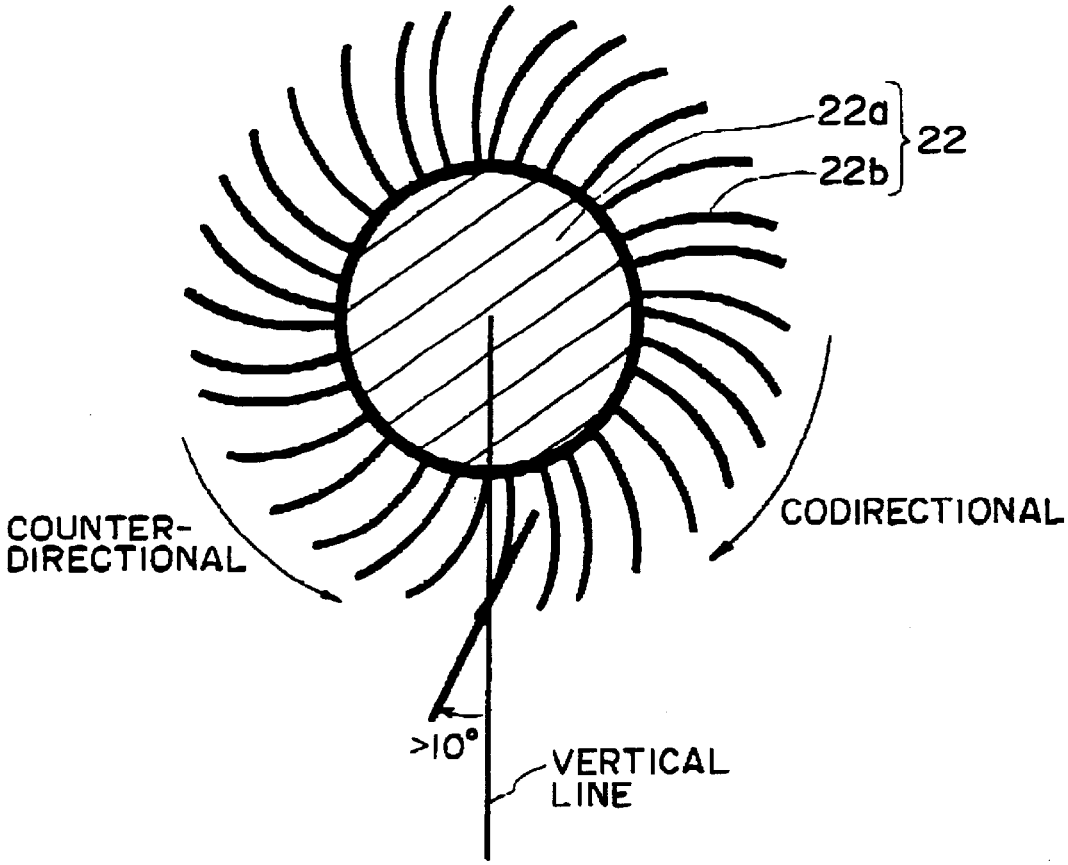
FIG. 14 is a further enlarged schematic cross-sectional view of the furbrush roller.

FIG. 13 is an enlarged schematic section of the fur brush roller 22 and its adjacencies depicted in FIG. 12. FIG. 14 is a further enlarged schematic section of the fur brush roller 22.

The fur brush roller 22 as the contact type charging member in this embodiment is a roller brush with an external diameter of 14 mm and a length of 250 mm, and comprises a metallic core 22*a* and a brush portion 22*b*. The metallic core 22*a* has a diameter of 6 mm, and doubles as an electrode. The brush portion 22*b* is composed of a piece of tape with pile of electrically conductive Rayon fiber (Rayon REC-B of Unitika Ltd.), which is spirally wound around the peripheral surface of the metallic core 22*a*. The density of the pile (density of bristle or fiber) of the brush portion 22*b* is 300 denier/50 filaments, or 155 bristles per square millimeter.

This roller brush is inserted, while being rotated in a predetermined direction, into a piece of pipe with an internal diameter of 12 mm, and is kept in the pipe in such a manner that the brush and the pipe remain coaxial. Then, the brush and the pipe are left in a high temperature-high humidity environment so that the bristles become permanently slanted, or cured. As a result, the fur brush roller 22, the bristles of which are slanted as schematically shown in FIG. 13 or 14, is obtained. The method for slanting the bristles of the fur brush roller does not need to be limited to the method described above. For example, there is available such a method in which the bristles are slanted by blowing high temperature air on the bristles while rotating the fur brush roller 22 in a predetermined direction.

The electrical resistance value of the fur brush roller 22 is $1\times10^5$ Ω when a voltage of 100 V is applied. This resistance value was calculated from the current which flowed when the voltage of 100 V was applied, with the fur brush roller 22 being placed in contact with a metallic drum with a diameter of 30 mm, with a contact pressure high enough to form a contact nip with a width of 3 mm.

If a given spot on the peripheral surface of the photosensitive member 1, or the object to be charged, becomes defective in terms of electrical resistance, for example, if a pin hole or the like appears on the peripheral surface of the photosensitive member 1, an excessive amount of current leaks through this spot, and as a result, the charging nip n fails to properly charge the photosensitive member 1. In order to prevent the occurrence of such a problem, the electrical resistance value of the fur brush type charging member is desired to be no less than $10^4$ Ω, whereas in order to inject a sufficient amount of charge into the peripheral surface of the photosensitive member 1, it is desired to be no more than $10^7$ Ω.

As for the material for the brush, there are other materials besides RED-B of Unitika Ltd. For example, it is possible to consider REC-C, REC-M1 and REC-M10 of Unitika Ltd., SA-7 of Toray Industries, Inc., SANDAARON of Nippon Sanmoo, BERUTORON of Kanebo, Ltd., Rayon of KURAKAABO of Kuraray Co., Ltd., and ROOBARU of Mitsubishi Rayon Co., Ltd., in which carbon is dispersed. However, in consideration of the stability of the brush in the environment in which the roller is used, REC-B, REC-M and REC-M10 of Unitika Ltd. are desirable.

It is desirable that each bristle of the brush has a size of 3–10 denier, and the density of the bristles is 10–100 bristle/bundle, or 80–100 bristle/mm. The bristle length is desired to be 1–10 mm.

Further, it is desirable that the angle of the bristle is no less than 10 deg. from the line normal to the peripheral surface of the metallic core 22*a*. More specifically, the angle of the bristle means the angle between the normal line, that is, the line passing through the bottom point of a bristle at the peripheral surface of the metallic core 22*a*, and the center of the metallic core 22*a*, and the line tangential to the curvature of the top end of the bristle.

The fur brush roller 22 in this embodiment is rotatively driven in the clockwise direction as indicated in FIG. 13. That is, it is rotated in contact with the photosensitive member 1 in such a manner that it moves in the direction opposite (counter) to the moving direction of the photosensitive member 1, maintaining a predetermined velocity difference from the peripheral surface of the photosensitive member 1, in the charging nip n.

Further, the apparatus in this embodiment is structured so that the peripheral surface of the photosensitive member 1 moves against the grain, or the extending direction, of the slanted bristles of the fur brush roller 22.

More specifically, in this embodiment, the moving direction of the peripheral surface of the fur brush roller 22 is opposite to the moving direction of the peripheral surface of the photosensitive member 1, and therefore, the apparatus is structured so that the bristles on the fur brush roller 22 are slanted upstream in terms of the rotational direction of the fur brush roller 22, as shown in FIG. 13, when they are not in contact with the peripheral surface of the photosensitive member 1. That is, the apparatus is structured so that the extending direction of the bristles 22*b* of the fur brush roller 22 are against the moving direction of the peripheral surface of the photosensitive member 1.

Figure 15:
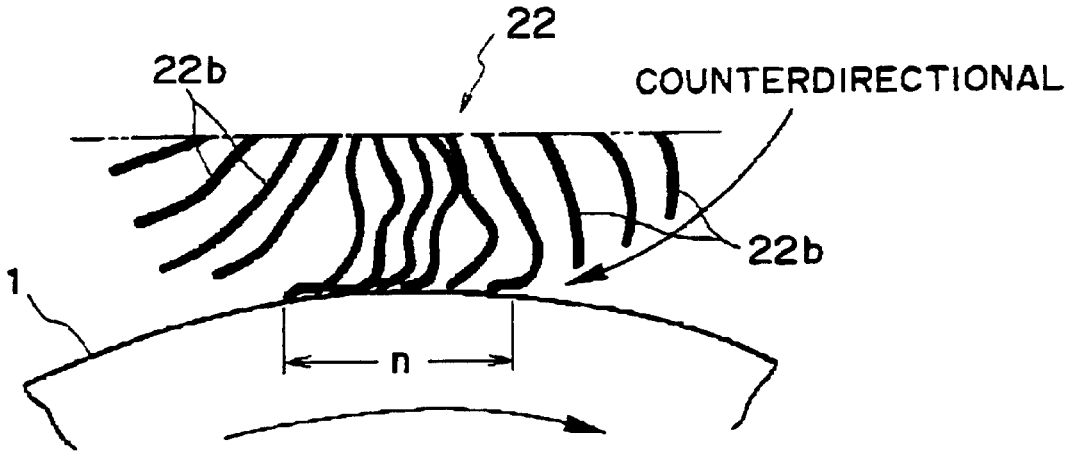
FIG. 15 ia an enlarged schematic view of a charging nip in the case of counterdirectional contact sliding.

Therefore, as the bristles 22*b* of the fur brush roller 22 are caused to enter the charging nip n by the rotation of the fur brush roller 22, they are deformed into various shapes, as depicted in FIG. 15, as they make contact with the peripheral surface of the photosensitive member 1, which are moving against the grain, or the extending direction of the bristles, of the charge roller 2. This deformation of the bristles 22*b* improves the state of contact between the fur brush roller 22 and the peripheral surface of the photosensitive member 1.

Figure 16:
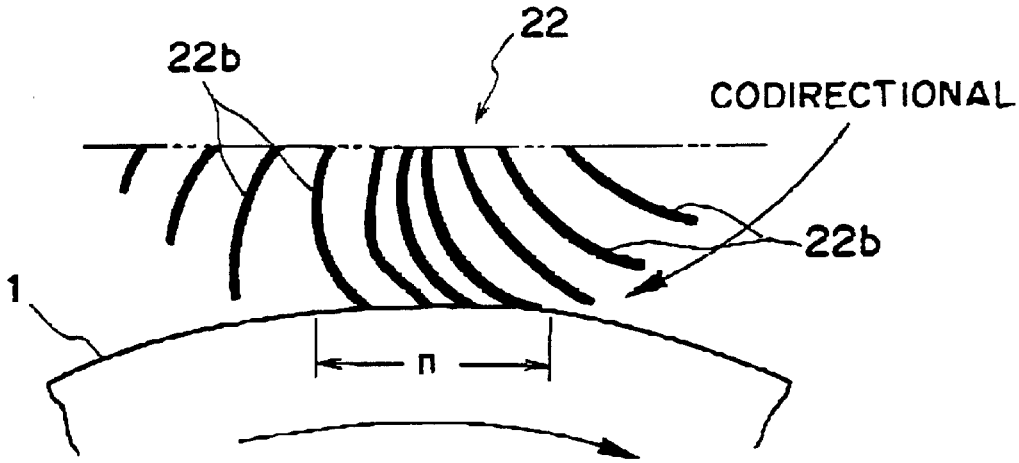
FIG. 16 is an enlarged schematic view of a charging nip in the case of codirectional contact sliding.

FIG. 16 depicts a comparative arrangement that the extending direction of the bristles 22*b* coincides with the moving direction of the peripheral surface of the photosensitive member 1. In this case, the fur brush roller 22 and the photosensitive member 1 rub against each other in such a manner that the peripheral surface of the photosensitive member 1 moves in the direction of the grain, or the extending direction of the bristles 22*b* of the fur brush roller 22, and therefore, the bristles 22*b* of the fur brush roller 22 bend downstream, in terms of the rotational direction of the photosensitive member 1, only slightly more as they come in contact with the peripheral surface of the photosensitive member 1 than when they are not in contact with the peripheral surface of the photosensitive member 1. In other words, even in the charging nip n, they maintain practically the same shape as they take when they are not in contact with the peripheral surface of the photosensitive member 1. Thus, the state of contact between the fur brush roller 22 and the photosensitive member 1 in the charging nip n in this comparative arrangement is less tight compared to the aforementioned counter-grain contact. Further, the amount of rubbing which occurs between the fur brush roller 22 and the photosensitive member 1 is only proportional to the peripheral velocity difference between the two, which causes some areas of the photosensitive member 1 to have less contact with the fur brush roller 22, and these areas are insufficiently charged.

In this embodiment, a DC voltage of −700 V is applied to the metallic core 22*a* of the fur brush roller 22, by which the peripheral surface of the photosensitive member 1 is charged to a potential level substantially equal to the level of the applied voltage. That is, in the case of the contact type charging of the photosensitive member 1 by the fur brush roller 22 in this embodiment, the direct charge injection process plays the dominant role; electrical charge is directly injected into the photosensitive member 1 as the slanted bristles of the fur brush roller 22 rub the peripheral surface of the photosensitive member 1, leaving virtually no spot on the peripheral surface of the photosensitive member 1 untouched, in the charging nip n between the fur brush roller 22 and the photosensitive member 1 as the object to be charged.

Assuming that in this embodiment, the peripheral velocity of the fur brush roller 22, or the velocity at which the peripheral surface of the fur brush roller 22 moves, is A mm/sec, and the peripheral velocity of the photosensitive member 1, or the velocity at which the peripheral surface of the photosensitive member 1 moves, is B mm/sec, if B has a positive value, then A has a negative value, because the fur brush roller 22 and the photosensitive member 1 are rotated in such directions that their peripheral surfaces move in the opposite directions in the charging nip n. Therefore, $B-A>0$. Thus, the image forming apparatus is structured so that the extending direction of the bristles 22*b* coincides with the upstream direction in terms of the moving direction of the photosensitive member 1, causing the peripheral surface of the photosensitive member 1 to move against the grain, or the extending direction of the bristles 22*b* of the fur brush roller 22.

However, the structure of an image forming apparatus does not need to be limited to the above described one. For example, the fur brush roller 22 may be rotated in such a manner that the peripheral surfaces of the fur brush roller 22 and the photosensitive member 1 move in the same direction in the charging nip n. In such a case, an image forming apparatus is structured as described below.

That is, when the absolute value of A is smaller than that of B, in other words, when the peripheral velocity of the fur brush roller 22 is slower than that of the photosensitive member 1, $B-A>0$. in this case, the apparatus is structured so that the direction in which the bristles 22*b* extend coincides with the upstream direction in terms of the rotational direction of the photosensitive member 1.

On the other hand, when the absolute value of A is greater than that of B, in other words, when the peripheral velocity of the fur brush roller 22 is faster than that of the photosensitive member 1, $B-A<0$. In this case, the apparatus is structured so that the direction in which the bristles 22*b* extend coincides with the downstream direction in terms of the rotational direction of the photosensitive member 1.

With the above arrangement, the peripheral surface of the photosensitive member 1 moves against the grain of the peripheral surface of the fur brush roller 22 while the fur brush roller 22 and the photosensitive member 1 are driven.

When the photosensitive member 1 was charged using the above structure, the bristles 22*b* of the fur brush roller 22 hung up on the microscopic irregularities on the peripheral surface of the photosensitive member 1 as they came in contact with the peripheral surface of the photosensitive member 1, becoming deformed. As a result, the state of contact between the peripheral surfaces of the fur brush roller 22 and photosensitive member 1 became tighter and more uniform, and therefore; the photosensitive member 1 was desirably charged in terms of uniformity, without the need for increasing the peripheral velocity of the charging member or the voltage applied to the charging member.

As for the photosensitive member, it is desirable to employ the one described in Embodiment 2, illustrated in FIG. 7.

Embodiment 7

This embodiment is substantially the same as Embodiment 6, except for the following feature additional to the features described in Embodiment 6.

That is, at least the nip between the fur brush type charging member and the object to be charged is supplied with electrically conductive particles. With the addition of this feature, the rotation of the fur brush type charging member is stabilized, and the size of the contact area between the fur brush type charging member and the object to be charged increases, improving the state of contact, and therefore, electrical charge can be directly injected into the object to be charged, more reliably and uniformly.

The electrically conductive particles are such particles that are intended for enhancing the performance of the charge roller in charging the object. The object is charged through the contact type charging process, with the presence of the charging performance enhancing particles in the nip portion between the object to be charged and the fur brush type charging member.

With the presence of these charging performance enhancing particles, the fur brush type charging member and the object to be charged can be more easily rotated in contact with each other while maintaining a peripheral velocity difference in the nip portion between the object to be charged and the fur brush type charging member, because the charging performance enhancing particles serve as lubricant. At the same time, the charging performance enhancing particles present on the surfaces of the bristles improve the state of contact between the fur brush type charging member and the object to be charged; the fur brush type charging member, along with the charging performance enhancing particles present in the nip between the fur brush type charging member and the object to be charged, makes contact with the peripheral surface of the object to charged, leaving no portion of the peripheral surface of the photosensitive member untouched. Thus, in cooperation with the function of the aforementioned bristles which extend in the direction opposite to the moving direction of the peripheral surface of the object to be charged, the presence of the charging performance enhancing particles enables electrical charge to be directly injected, more reliably and uniformly.

This embodiment is such an embodiment that employs both the slanted bristles and the charging performance enhancing particles.

Figure 17:
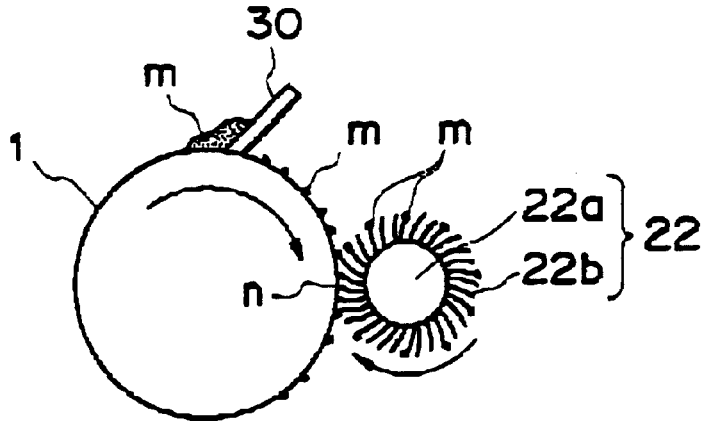
FIG. 17 is a schematic view of a charging device using charging-promotion particles.
Figure 22:
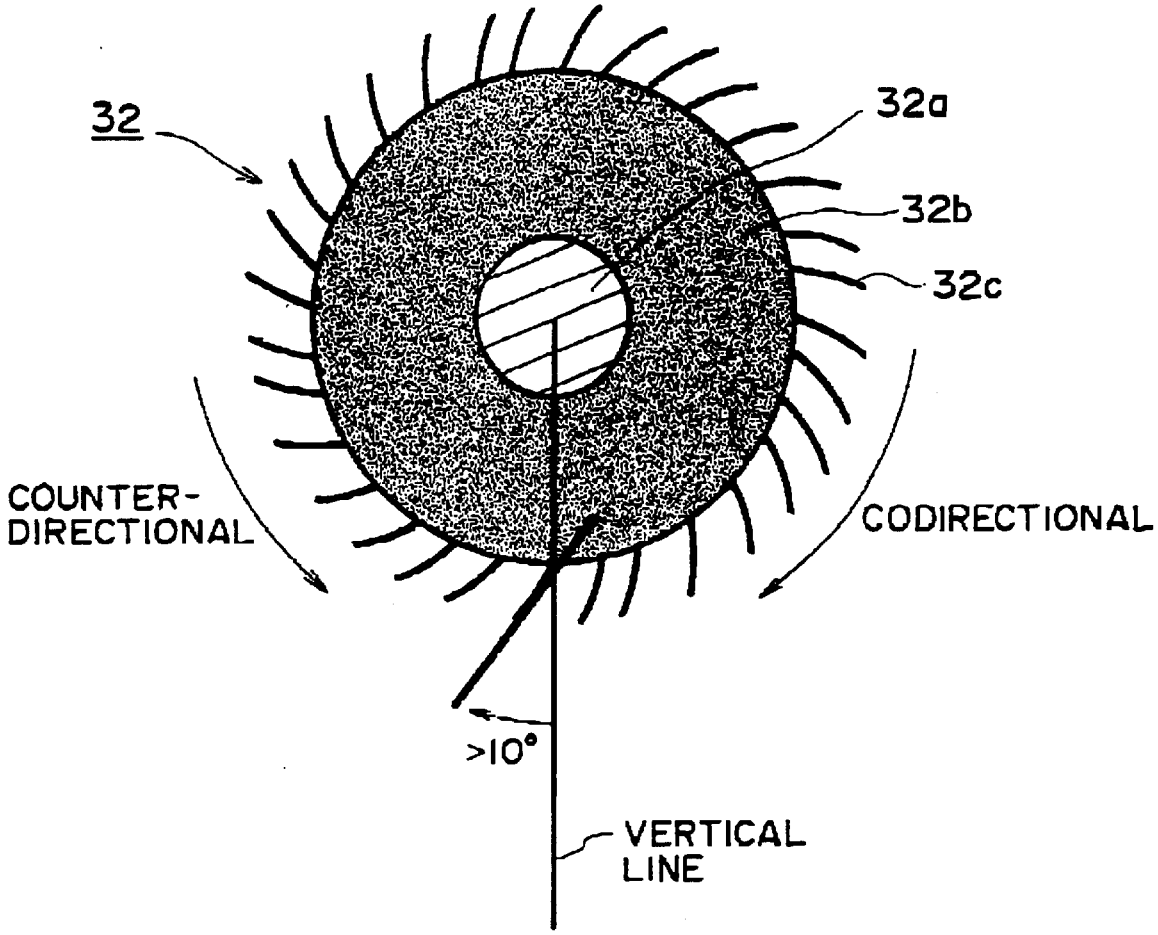
FIG. 22 is a further enlarged schematic cross-sectional view of an elastic-fiber-planted roller.
Figure 23:
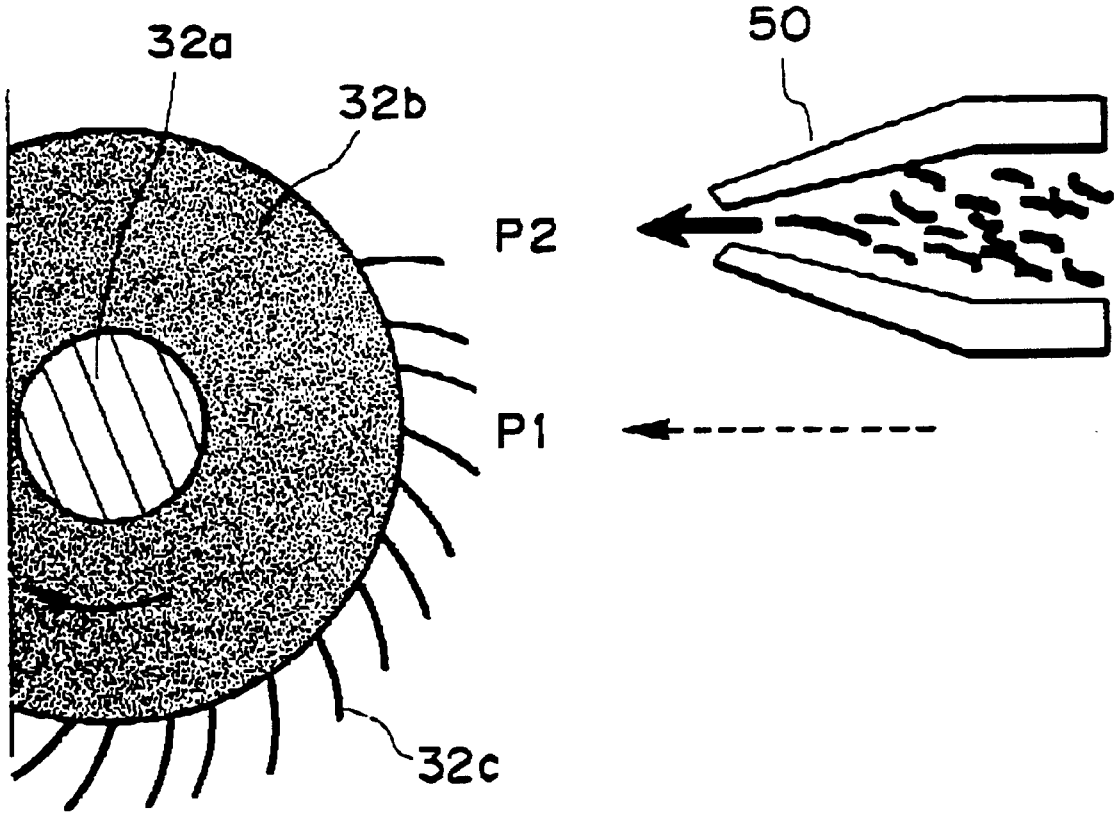
FIG. 23 is an illustration of an example of a planting method.

Referring to FIG. 17, a referential FIG. 1 designates an object to be charged, for example, an electrophotographic photosensitive member of a rotational drum type, and a referential FIG. 22 designates a fur brush type charge roller as a contact type charging member. A referential FIG. 30 designates a regulating blade as a means for coating the charging performance enhancing particles, and a referential character m designates a charging performance enhancing particle.

a. Fur Brush Type Charge Roller 22

The fur brush type charge roller 22 is the same as the fur brush type charge roller 22 in Embodiment 6. Its peripheral surface is provided with slanted bristles. It is rotated in contact with the photosensitive member 1, maintaining a predetermined peripheral velocity difference from the photosensitive member 1, to cause the peripheral surface of the photosensitive member 1 to move against the grain, or the extending direction of the slanted bristles, of the fur brush type charge roller 22, to directly inject electrical charge into the photosensitive member 1.

b. Charging Performance Enhancing Particles m

The charging performance enhancing particles m employed in this embodiment are the same as those described in Embodiment 4.

c. Charging Performance Enhancing Particle Coating Means 30

In this embodiment, in order to uniformly supply the charging nip n between the fur brush type roller 22 and the photosensitive member 1 with the charging performance enhancing particles m, and hold them there, the charging performance enhancing particle coating means 30 is disposed on the upstream side of the charging nip n in terms of the rotational direction of the photosensitive member 1.

The charging performance enhancing particle coating means 30 in this embodiment is a regulating blade placed in contact with the photosensitive member 1, and is structured to hold the charging performance enhancing particles m between the photosensitive member 1 and the regulating blade 30.

With this structural arrangement, a predetermined amount of the charging performance enhancing particles m is coated on the peripheral surface of the photosensitive member 1 as the photosensitive member 1 is rotated, and is carried to the charging nip n to supply the charging nip n with the charging performance enhancing particles m. Then, in the charging nip n, the charging performance enhancing particles m are uniformly coated onto the fur brush type charge roller 22, or uniformly distributed across the charging nip n.

The charging performance enhancing particle supplying structure does not need to be limited to the one described above; much simpler structures may be employed. For example, a method, in which a foamed member, or a fur brush, impregnated with the charging performance enhancing particles m is placed in contact with the object 1 to be charged or the fur brush roller 22, may be employed.

d. Direct Charge Injection

The photosensitive member 1 is in the form of a drum with a diameter of 30 mm, and is rotated at a constant peripheral velocity of 50 mm/sec.

As the photosensitive member 1 is rotated, the charging performance enhancing particles m are coated on the peripheral surface of the photosensitive member 1 by the regulating blade 30, and reach the charging nip n.

The fur brush roller 22 is driven at approximately 80 rpm so that the peripheral surfaces of the fur brush roller 22 and the photosensitive member 1 move at a constant velocity in the opposite directions in the charging nip n.

Figure 18:
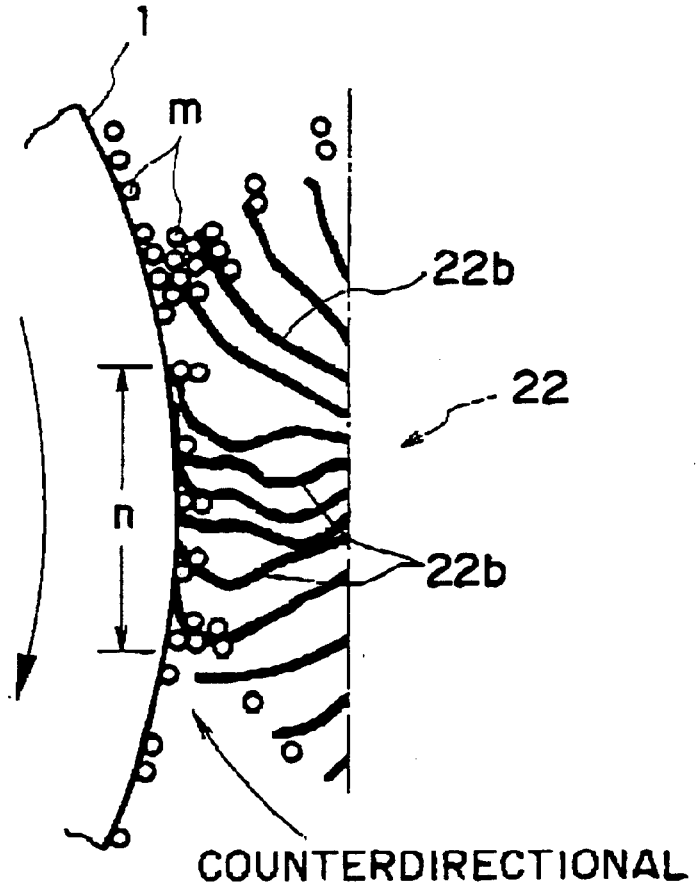
FIG. 18 is an enlarged schematic view of a charging nip.

Thus, in this embodiment, the slanted bristles 22*b* of the fur brush roller 22 make contact with the peripheral surface of the photosensitive member 1, deforming in various shapes, in the charging nip n, and at the same time, the charging performance enhancing particles m coated on the photosensitive member 1 are easily picked up, or scooped up, by the slanted bristles of the fur brush roller 22, as shown in FIG. 18 which is an enlarged schematic section of the charging nip n. In other words, the deformation of the bristles of the fur brush roller 22, and the presence of the charging performance enhancing particles m, in the charging nip n, improve the state of contact between the fur brush roller 22 and the photosensitive member 1.

To the metallic core 22*a* of the fur brush roller 22, a DC voltage of −700 V is applied, whereby the peripheral surface of the photosensitive member 1 is charged to a potential level equal to the level of the applied voltage.

In other words, in the case of the contact type charging process in this embodiment, a process of direct charge injection plays a dominant role. That is, electrical charge is directly injected as the slanted bristles of the fur brush roller 22 and the charging performance enhancing particles m present in the charging nip n between the fur brush roller 22 and the photosensitive member 1 rub the peripheral surface of the photosensitive member 1 without leaving any portion of the peripheral surface of the photosensitive member untouched.

When the photosensitive member 1 was charged using the fur brush type charging apparatus with the structure described above, the slanted bristles of the fur brush roller 22 hung up on the microscopic irregularities on the peripheral surface of the photosensitive member 1, deforming in various shapes, as they came in contact with the peripheral surface of the photosensitive member 1. Further, the presence of the slanted bristles on the fur brush roller 22 made it easier for the charging performance enhancing particles m to be picked up by the peripheral surface of the fur brush roller 22. As a result, the fur brush roller 22 made contact with the peripheral surface of the photosensitive member 1, more uniformly and tighter. Consequently, the photosensitive member 1 was desirably charged in terms of the uniformity of charge.

According to an experiment, a desirable amount of the charging performance enhancing particles m in the charging nip n was $10^3$–$5\times10^5$ particle/mm$^2$.

Embodiment 8

In this embodiment, the present invention is embodied in the form of a cleanerless (toner recycling) image forming apparatus, that is, an image forming apparatus which does not have a cleaning apparatus. As for the contact type charging member, a fur brush type roller with bristles slanted in the direction opposite to the rotational direction of a photosensitive member is employed. Also, in order to improve the state of contact between the charging member and the photosensitive member, the apparatus is structured so that the charging performance enhancing particles are supplied between the charging member and the photosensitive member. Further, in order to improve the chargeability of the photosensitive member, the photosensitive member is provided with a charge injection layer as the surface layer. As a result, not only is the charging performance improved, but also, images which do not suffer from the flaws associated with the residual toner particles can be outputted by the image forming apparatus, in spite of the fact that the apparatus does not comprise a cleaning apparatus.

Figure 19:
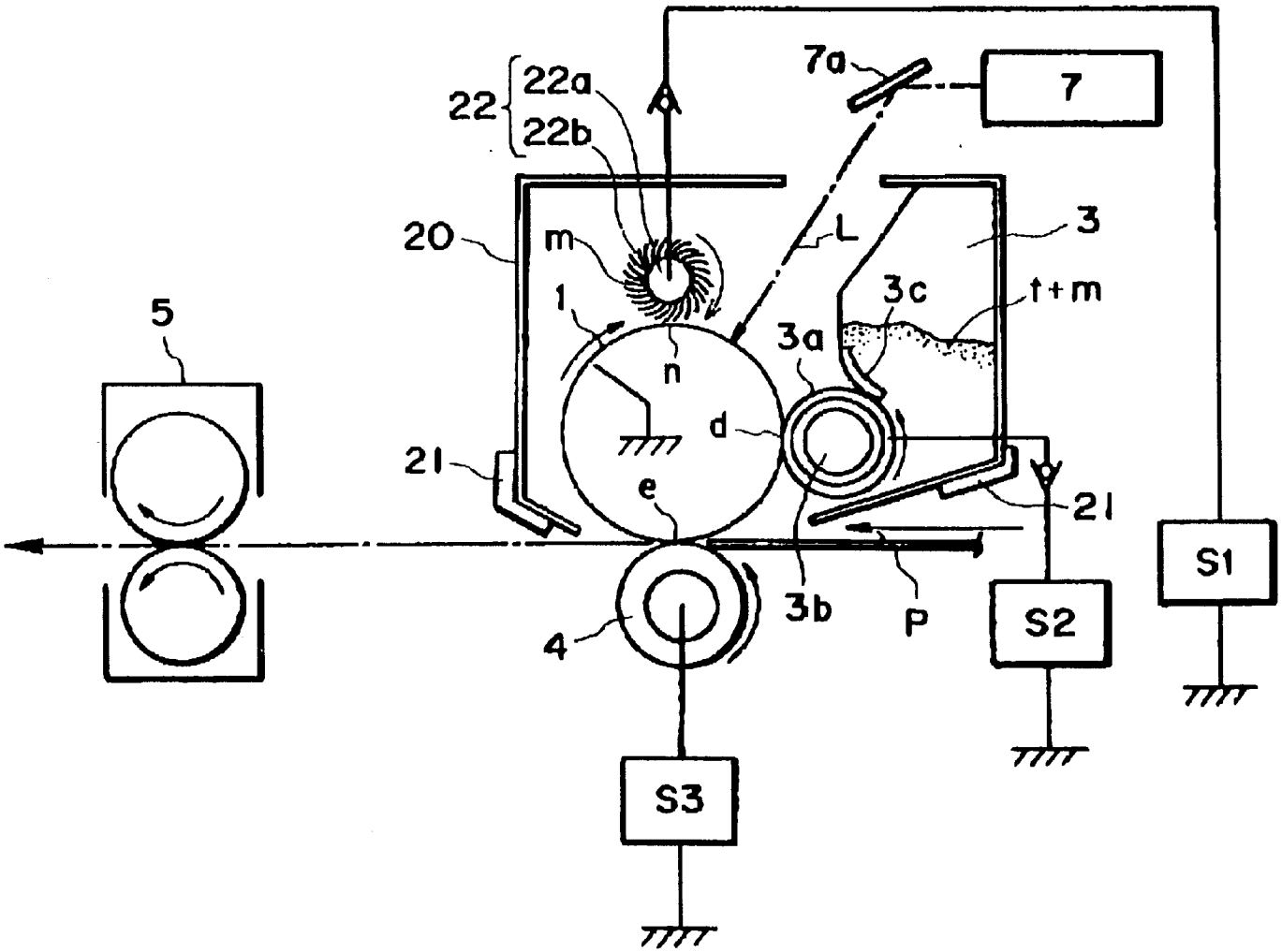
FIG. 19 is a schematic view of a cleanerless type image forming apparatus.

FIG. 19 is a schematic section of the cleanerless image forming apparatus in this embodiment, and depicts the general structure thereof. The printer in this embodiment is substantially identical to the printer in Embodiment 6, except that this printer lacks the cleaning apparatus 6. The structural members or portions which are the same as those in the printer in Embodiment 6 are designated with the same referential codes as those used in Embodiment 6 to omit the repetition of the same descriptions.

a. Photosensitive Member 1

The photosensitive member 1 is such a photosensitive member that has a charge injection layer 16 as the surface layer, like the photosensitive member 1 in Embodiment 2.

b. Fur Brush Roller 22

The fur brush roller 22 in this embodiment is the same as the one described in Embodiment 6. It comprises slanted bristles like the fur brush roller 22 in Embodiment 6. Electrical charge is directly injected into the photosensitive member 1 by rotating the fur brush roller 22 and photosensitive member 1 in such a manner that the peripheral surface of the photosensitive member 1 moves against the grain, or the extending direction of the slanted bristles of the fur brush roller 22, maintaining a peripheral velocity difference between the fur brush roller 22 and photosensitive member 1.

As for the structural arrangement for providing the fur brush roller 22 and the photosensitive member 1 with a peripheral velocity difference in a cleanerless image forming apparatus like the one in this embodiment, it is desirable that in order to temporarily recover the residual toner particles, the fur brush roller 22 is rotatively driven in such a direction that its rotational direction in the charging nip n opposes the rotational direction of the photosensitive member 1 in the charging nip n.

c. Charging Performance Enhancing Particles m

In this embodiment, the charging performance enhancing particles m are coated on the surface of the fur brush roller 22 in advance, so that the photosensitive member 1 can be desirably charged from the very start of each charging process.

Further, the charging performance enhancing particles m are mixed by two parts in weight in the single component magnetic toner t, as developer, stored in the developing apparatus 3.

The charging performance enhancing particles m mixed in the developer t adhere to the peripheral surface of the photosensitive member 1 when an electrostatic latent image on the peripheral surface of the photosensitive member 1 is developed, and then are supplied to the charging nip n by being carried to the charging nip n, through the transfer nip e, as the photosensitive member 1 is rotated.

The charging performance enhancing particles m employed in this embodiment are electrically conductive zinc oxide particles with a diameter of 3 $\mu$m. They are desired to be nearly colorless or white so that they do not interfere with an exposing process for forming a latent image, in particular, when they are used for enhancing the efficiency with which a photosensitive member is charged. Further, when they are used to enhance color recording, they are desired to be nearly colorless or white, in consideration of the fact that the charging performance enhancing particles m may be transferred onto a recording sheet P from a photosensitive member. Further, in order to prevent the charging performance enhancing particles m from scattering the light when a photosensitive member is exposed for latent image formation, the size of the charging performance enhancing particle m is desired to be smaller than the size of a picture element.

d. Direct Charge Injection

The photosensitive member 1 is in the form of a drum with a diameter of 30 mm, and is rotated at a constant peripheral velocity of 50 mm/sec. The fur brush roller 22 is driven at approximately 80 rpm, in such a manner that the peripheral surfaces of the fur brush roller 22 and the photosensitive member 1 move at constant velocities in the opposite directions in the charging nip n. To the metallic core 22*a* of the fur brush roller 22, a DC voltage of −700 V is applied.

Also in this embodiment, the slanted bristles of the fur brush roller 22 make contact with the peripheral surface of the photosensitive member 1, deforming in various shapes, in the charging nip n, and as they come in contact with the peripheral surface of the photosensitive member 1, the charging performance enhancing particles m present in the charging nip n are picked up, or scooped up, into the peripheral surface of the fur brush roller 22 by the slanted bristles of the fur brush roller 22. This deformation of the slanted bristles of the fur brush roller 22, and the presence of the charging performance enhancing particles m in the charging nip n, combine to improve the state of contact between the fur brush roller 22 and the photosensitive member 1 as they do in Embodiment 7.

With the above arrangement, the peripheral surface of the photosensitive member 1 is charged to a potential level equal to the level of the applied voltage. That is, in the case of the contact type charging system in this embodiment, the direct charge injection process plays the dominant role; the slanted bristles 22*b* of the fur brush roller 22, and the charging performance enhancing particles m present in the charging nip n between the fur brush roller 22 and the photosensitive member 1 coordinate to rub the peripheral surface of the photosensitive member 1, leaving no portion of the peripheral surface of the photosensitive member untouched, to directly inject charge into the photosensitive member 1.

e. Cleanerless System

As described above, the rotating photosensitive member 1 is charged by the fur brush roller 22, to a substantially the same potential level as the level of the voltage applied to the fur brush roller 22, through the direct charge injection process. Then, the charged surface of the photosensitive member 1 is exposed to a scanning laser beam L from a laser beam scanner 7, and as a result, an electrostatic latent image correspondent to a desired print pattern is formed on the peripheral surface of the rotating photosensitive member 1.

Then, the electrostatic latent image is developed in reverse into a toner image by the developing apparatus 3, and the toner image is sequentially transferred from one end to the other onto a transfer sheet P, as recording medium, delivered with a predetermined timing to the transfer nip e from an unillustrated sheet feeding section.

After receiving the toner image in the transfer nip e, the transfer sheet P is separated from the peripheral surface of the rotating photosensitive member 1, and is introduced into a fixing apparatus 5, in which the toner image is permanently fixed to the transfer sheet P. Thereafter, the transfer sheet P is discharged as a print or a copy from the image forming apparatus.

In the case of a cleanerless image forming apparatus, the residual toner particles (developer particles), i.e. the toner particles remaining on the peripheral surface of the photosensitive member 1 after toner image transfer, are carried virtually undisturbed to the charging nip n between the fur brush roller 22 and the photosensitive member 1 as the photosensitive member 1 is rotated In the charging nip n, the residual toner particles are adhered to, or impregnated into, the fur brush roller 22 while being stirred by the bristles 22*b* of the fur brush roller 22, which extend in the direction opposite to the rotational direction of the photosensitive member 1 (the residual toner particles are temporarily recovered by the fur brush roller 22). Because the toner particles are generally insulator, their adhesion to, or impregnation into, the fur brush roller 22 becomes one of the factors that are responsible for improper charging of the photosensitive member 1.

However, in this embodiment, the charging performance enhancing particles m are coated in advance on the fur brush roller 22, and the charging performance enhancing particles m mixed in the developer t (toner) in the developing apparatus are carried to the charging nip n through the developing and transferring processes, and are supplied to the fur brush roller 22. Therefore, the charging performance enhancing particles m are always present in the charging nip n to keep the state of contact between the fur brush roller 22 and the photosensitive member 1 tight enough to maintain desirable contact resistance between the fur brush roller 22 and the photosensitive member 1. As a result, in spite of the contamination of the fur brush roller 22 by the residual toner particles, charge can be directly injected. In other words, electrical charge can be directly and continuously injected into the photosensitive member 1 with the application of relatively low voltage to the fur brush roller 22, thus generating substantially no ozone, to uniformly charge the photosensitive member 1.

The residual toner particles which adhere to, or are impregnated into, the fur brush roller 22, are electrically discharged from the fur brush roller 22 gradually onto the photosensitive member 1. Since the fur brush roller 22 bears the charging performance enhancing particles m in this embodiment, the strength with which the residual toner particles adhere to the fur brush roller 22 is reduced, improving the efficiency with which the residual toner particles are discharged from the fur brush roller 22 onto the photosensitive member 1.

After being discharged onto the photosensitive member 1 from the fur brush roller 22, the toner particles arrive at the developing station d as the peripheral surface of the photosensitive member 1 is rotatively moved. Then, they are recovered by the developing apparatus 3 (cleaning process carried out at the same time and location as developing process), or used for the developing process (toner recycling).

As described previously, in the process in which both cleaning and image development occur at the same time and location, the toner particles remaining on the photosensitive member 1 after image transfer are recovered during the developing process of the immediately following image formation cycle. In other words, in the immediately following image forming cycle, the photosensitive member 1 is charged, without removal of the residual toner particles, and exposed to form a latent image on the photosensitive member 1. Then, when the latent image is developed, the residual toner particles are recovered by the fog prevention bias Vback, that is, the difference between the level of the DC voltage applied to the developing apparatus 3, and the surface potential level of the photosensitive member 1, in the development apparatus 3. When the reversal development process is employed as it is by the printer in this embodiment, the cleaning-developing process is carried out by the functions of an electric field for recovering the residual toner particles onto a developing sleeve from the "dark" regions of the latent image on the peripheral surface of the photosensitive member 1, and an electrical field for adhering the toner particles to the "light" regions of the latent image on the peripheral surface of the photosensitive member 1.

Through repetition of the above described processes, electrical charge is directly injected into the photosensitive member 1, while recycling the toner, for a long period of service. The residual toner particles and the charging performance enhancing particles are picked up into the fur brush roller 22 while being stirred, and therefore, flawless images, which do not suffer from the ghosts attributable to the residual toner particles, can be outputted.

When images were outputted by the image forming apparatus in this embodiment, even the 5000th copy did not suffer from the ghosts attributable to the cleanerless structure of the apparatus; the charging performance of the apparatus remained stable.

In this embodiment, the residual toner particles are satisfactorily recovered, while being stirred, by the bristles **22*b* of the fur brush roller 22, which extend in the direction opposite to the rotational direction of the photosensitive member 1, and in addition, the bristles 22*b* and the charging performance enhancing particles m coordinate to make the state of contact between the fur brush roller 22 and the photosensitive member 1 satisfactorily tight for desirably charging the photosensitive member 1. Therefore, the image forming apparatus can output desirable images which do not suffer from flaws attributable to the passing of the residual toner particles through the charging nip n, or attributable to the improper charging of the photosensitive member 1**, in spite of the fact that the image forming apparatus is of a cleanerless type.

The charging performance enhancing particles m mixed into the single component magnetic toner t, as the developer, stored in the developing apparatus 3 adhere to the peripheral surface of the photosensitive member 1 during the development of an electrostatic latent image on the peripheral surface of the photosensitive member 1, and are supplied to the charging nip n by being carried to the charging nip n, through the transfer nip e, as the photosensitive member 1 is rotated.

More specifically, the toner image developed on the photosensitive member 1 actively transfers onto the transfer sheet P by being attached toward the transfer sheet P by the transfer bias, in the transfer nip e, whereas the charging performance enhancing particles m having adhered to the peripheral surface of the photosensitive member 1 during the latent image development on the peripheral surface of the photosensitive member 1 by the developing apparatus 3 do not actively transfer onto the transfer sheet P side, remaining adhered to the peripheral surface of the photosensitive member 1, practically undisturbed, because the charging performance enhancing particles m have a low electrical resistance value. Then, the charging performance enhancing particles m remaining on the peripheral surface of the photosensitive member 1 are supplied to the charging nip n by being carried to the charging nip n, through the transfer nip e, as the peripheral surface of the photosensitive member 1 rotationally moves.

As is evident from the above description, in this embodiment, the peripheral surface of the fur brush roller 22 is provided with the charging performance enhancing particles m, which are coated in advance on the peripheral surface of the fur brush roller 22, and also the charging performance enhancing particles m mixed in the developer t in the developing apparatus 3 are supplied to the fur brush roller 22 through the developing and transferring processes. Therefore, even when the residual toner particles adhere to, are impregnated into, the peripheral surface of the fur brush roller 22, the state of contact between the fur brush roller 22 and the photosensitive member 1 is kept tight enough to maintain desirable contact resistance between the fur brush roller 22 and the photosensitive member 1 for directly injecting electrical charge into the photosensitive member 1. Further, the charging performance enhancing particles m are continuously supplied from the developing apparatus 3, and therefore, even if the charging performance enhancing particles m fall off the fur brush roller 22, the desirable charging performance can be maintained. In other words, the desirable charging performance can be maintained from the very beginning through the long service life of the image forming apparatus.

Embodiment 9

Figure 20:
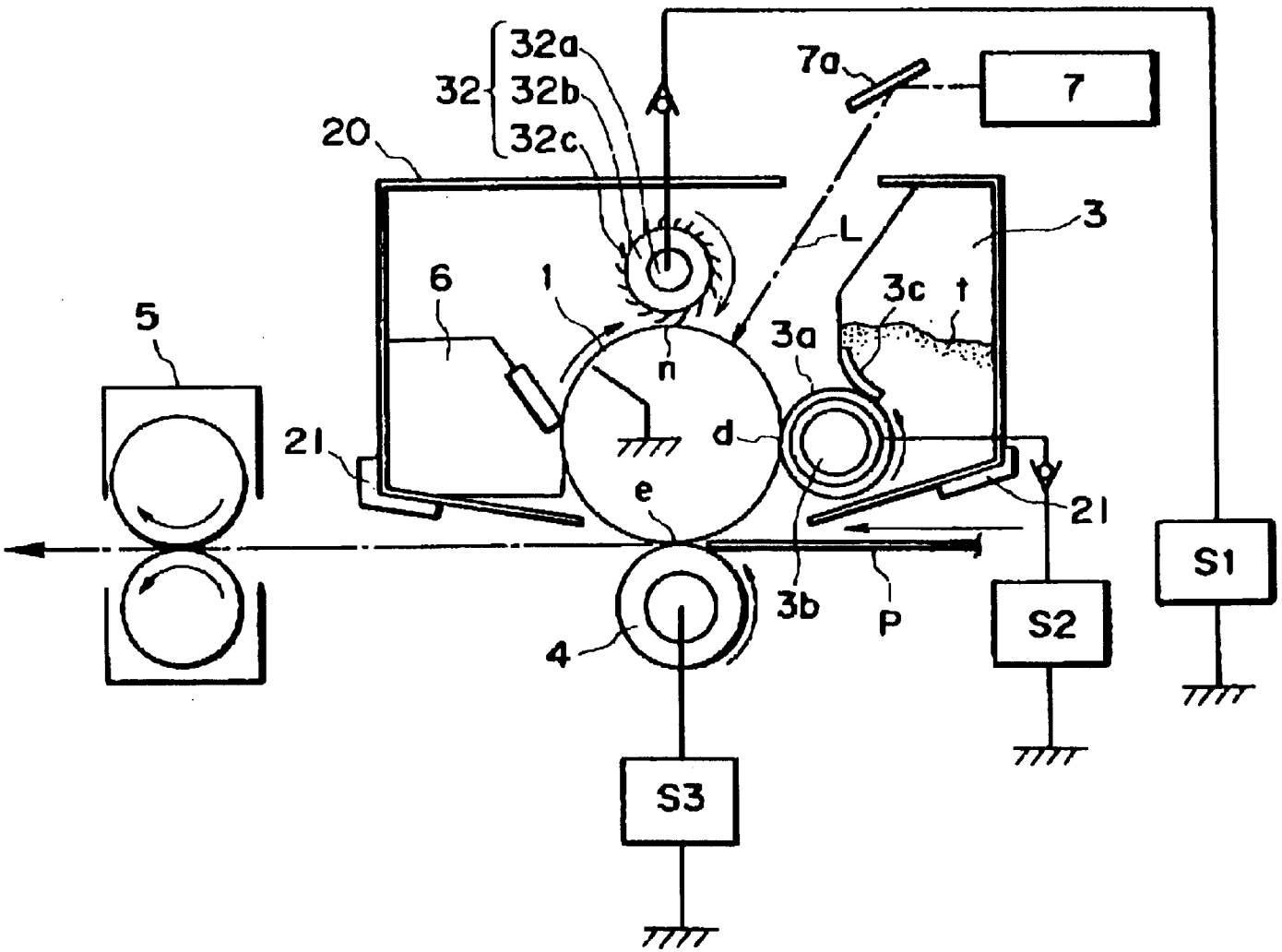
FIG. 20 is a schematic view of an image forming apparatus according to Embodiment 9.

In this embodiment, the present invention is embodied as an image forming apparatus employing an elastic charge roller with planted bristles, that is, a roller with an elastic layer and bristles planted on the elastic layer, as shown in FIG. 20, in place of the charge roller described in Embodiment 1. The components or portions other than the charge roller are not different from those in Embodiment 1, and therefore, their descriptions will be omitted here.

Figure 21:
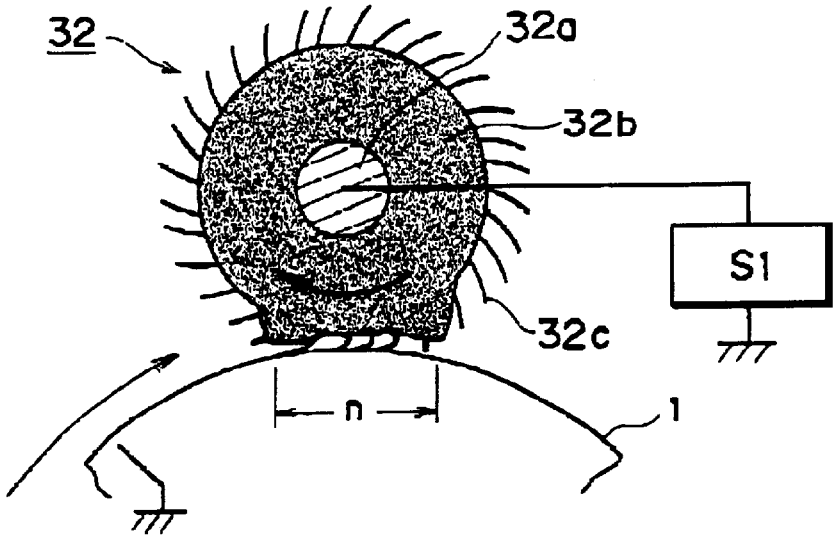
FIG. 21 is an enlarged schematic view of an elastic-fiber-planted roller portion which is a contact charging member.

FIG. 21 is an enlarged schematic cross section of the bristle planted elastic roller 32 and its adjacencies illustrated in FIG. 20. FIG. 22 is a further enlarged cross section of the bristle planted roller 32.

The bristle planted elastic roller 32 as the contact type charging member in this embodiment comprises the metallic care 32*a*, an electrically conductive elastic layer 32*b*, and a planted bristle layer 32*c*. The metallic core 32*a* doubles as an electrode, and has a diameter of 6 mm. The electrically conductive elastic layer 32*b* is integrally and coaxially formed on the peripheral surface of the metallic core 32*a*, and has a length of 250 mm and an external diameter of 11.5 mm. The planted bristle layer 32*c* is formed by spirally wrapping a belt, on which bristles with intermediate electrical resistance are planted, around the peripheral surface of the electrically conductive elastic layer 32*b*, after placing a layer of adhesive on the peripheral surface of the electrically conductive elastic layer 32*b*.

The electrically conductive elastic material for the electrically conductive elastic layer 32*b* is a foamed elastic material composed by dispersing carbon in urethane.

The belt with planted bristles, which is used to form the planted bristle layer 32*c*, is composed of a sheet of backing material, and bristles of SANDAARON (commercial name) of Nippon Sanmoo Co., Ltd., planted on the backing.

The planted bristle elastic roller 32 produced in the above described manner has an external diameter of 12.5 mm. This roller 32 is inserted, while being rotated in a predetermined direction, into a piece of pipe with an internal diameter of 12 mm, and is kept in the pipe in such a manner that the bristle planted elastic roller 32 and the pipe remain coaxial. Then, the bristle planted elastic roller 32 and the pipe are left in a high temperature-high humidity environment so that the bristles of the planted bristle layer 32*c* settle, or core, in a virtually permanent slanted position.

The method for slanting the bristles of the planted bristle layer 32*c* does not need to be limited to the method described above. For example, there is available such a method in which the bristles are slanted by blowing high temperature air on the bristles while rotating the bristle planted elastic roller 32 in a predetermined direction. With this method, the bristles of the planted bristle layer 32*c* are slanted as illustrated in FIG. 22.

It is desirable that the angles of the bristles are no less than 10 deg. from the line normal to the peripheral surface of the electrically conductive elastic layer 32*b*. More specifically, the angle of the bristle means the angle between the normal line, i.e. the line passing through the bottom point of a bristle at the peripheral surface of the electrically conductive elastic layer 32*b*, and the center of the metallic core 32*a* (direction of the line connecting the bottom point of a bristle and the center of the cross section of the charging member), and the line tangential to the curvature of the top end of the bristle.

The planted bristle layer 32*c* may be formed by directly planting the bristles on the peripheral surface of the electrically conductive elastic layer 32*b*, and in this case, the bristles may be planted at a slant, instead of slanting them after planting. For example, the bristles can be planted at a slant with the use of the following method. That is, the opening through which bristles are blown out is shifted slightly upward from the position correspondent to a point P1 on the electrically conductive elastic layer 32*b*, i.e. the position closest to the peripheral surface of the electrically conductive elastic layer 32*b*, to the position corresponding to a point P2 on the electrically conductive elastic layer 32*b*, so that the bristles are planted at a slant, at a desired angle.

The method for slanting the bristles does not need to be limited to the above described one. For example, there is a method in which the bristles are slanted by blowing high temperature air on the bristles while rotating the bristle planted elastic roller 32 in a predetermined direction after the planting of the bristles. With the use of these methods, the bristles of the planted bristle layer 32*c* are slanted as illustrated in FIG. 22.

The electrical resistance value of the bristle planted elastic roller 32 as a contact type charging member is $1\times10^5$ Ω when a voltage of 100 V is applied. This resistance value was calculated from the current which flowed when the voltage of 100 V was applied, with the bristle planted elastic roller 32 being placed in contact with a metallic drum with a diameter of 30 mm, with a contact pressure high enough to form a contact nip with a width of 3 mm.

If a given spot on the peripheral surface of the photosensitive member 1, or the object to be charged, becomes defective in terms of electrical resistances for example, if a pin hole or the like appears on the peripheral surface of the photosensitive member 1, an excessive amount of current leaks through this spot, and as a result, the charging nip n fails to properly charge the photosensitive member 1. In order to prevent the occurrence of such a problem, the electrical resistance value of the bristle planted elastic roller 32 is desired to be no less than $10^4$ Ω, whereas in order to inject a sufficient amount of charge into the peripheral surface of the photosensitive member 1, it is desired to be no more than $10^7$ Ω.

As for the material for the elastic layer of the bristle planted elastic roller 32, rubber or resin, the electrical resistance of which is adjusted by metallic particles, metallic oxide particles, ion conductive material, or the like, or the foamed version of these rubbers or resins, may be employed. More specifically, they are urethane in which carbon is dispersed, EPDM (ethylene propylene diene rubber) in which carbon is dispersed, or the like.

As for the hardness of the electrically conductive elastic layer 32*b*, if it is excessively low, the shape of the electrically conductive elastic layer 32*b* becomes instable, and therefore, the state of contact between the charging member and the object to be charged becomes inferior, whereas if it is excessively high, not only is the charging nip n unsatisfactorily formed, but also the state of contact between the charging member and the object to be charged becomes inferior in microscopic terms. Thus, the desirable hardness range for the electrically conductive elastic layer 32*b* is 25 degrees to 50 degrees in ASKER-C scale.

As for the material for the bristles for the planted bristle layer 32*b*, there are other materials besides SANDAARON of Nippon Sanmoo Co., Ltd. For example, it is possible to consider REC-B, REC-C, REC-M1 and REC-M10 of Unitika Ltd., SA-7 of Toray Industries, Inc., BERUTORON of Kanebo, Ltd., Rayon or KURAKAABO of Kuraray Co., Ltd., and ROOBARU of Mitsubishi Rayon Co., Ltd., in which carbon is dispersed. However, in consideration of stability in the environment in which the roller is used, REC-B, REC-M and REC-M10 of Unitika Ltd. are desirable. In addition, it is possible to use a piece of electrically nonconductive belt comprising a backing, and Rayon bristles, acrylic bristles, propylene bristles, or the like, which are planted on the backing. When such a belt is used, it is given an electrical resistance in a medium range by vapor deposition or coating.

The density of the bristles of the planted bristle layer 32*c* is desired to be 80–600 bristle/mm$^2$, and their length is desired to be 0.05–1 mm.

The bristle planted elastic roller 32 is rotatively driven at a predetermined peripheral velocity, in the clockwise direction indicated by an arrow mark in FIG. 21, that is, in such a direction that the direction in which the peripheral surface of the bristle planted elastic roller 32 moves in the charging nip n opposes (counter) the direction in which the peripheral surface of the photosensitive member 1 moves in the charging nip n; the bristle planted elastic roller 32 is rotatively driven in contact with the peripheral surface of the photosensitive member 1, in a manner to provide a velocity difference between the peripheral surfaces of the bristle planted elastic roller 32 and the photosensitive member 1.

Further, the apparatus is structured so that the bristle planted elastic roller 32 is rotated in contact with the peripheral surface of the photosensitive member 1 in such a direction that the extending direction of the bristles of the planted bristle layer 32*c* of the bristle planted elastic roller 32 opposes the direction in which the peripheral surface of the photosensitive member 1 is moved.

In other words, in this embodiment, the direction of the movement of the peripheral surface of the bristle planted elastic roller 32 in the charging nip n is opposite to the direction of the movement of the peripheral surface of the photosensitive member 1 in the charging nip n. Thus, he apparatus is structured so that the bristles of the planted bristle layer 32*c* of the bristle planted elastic roller 32 are slanted in the downstream direction relative to the rotational direction of the bristle planted elastic roller 32, as shown in FIG. 21, when they are not in contact with the peripheral surface of the photosensitive member 1. Therefore, the bristle planted elastic roller 32 is rotated in such a direction that the extending direction of the bristles of the bristle planted elastic roller 32 opposes the direction in which the peripheral surface of the photosensitive member 1 is moved in the charging nip n.

Figure 24:
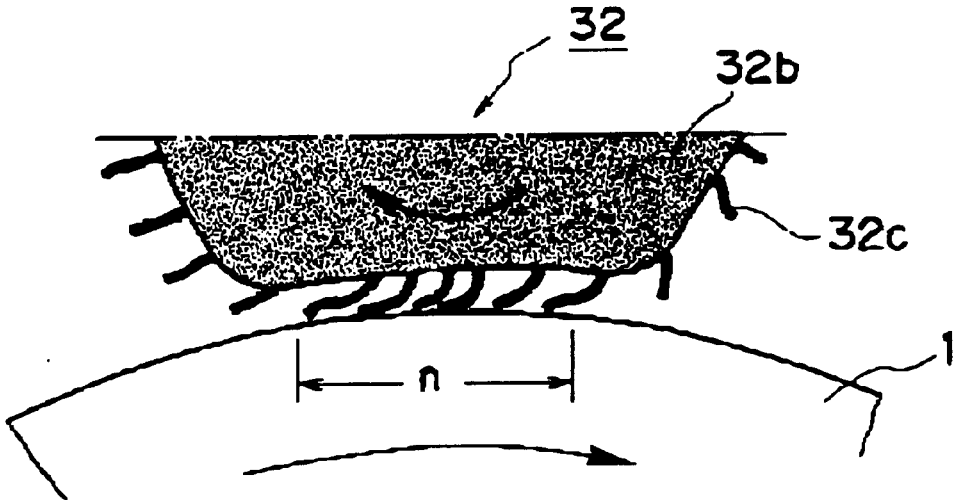
FIG. 24 ia an enlarged schematic view of a charging nip in the case of counterdirectional contact sliding.

Thus, the peripheral surface of the photosensitive member 1 is rubbed by the bristles of the bristle planted elastic roller 32, which are slanted in the direction opposite to the moving direction of the peripheral surface of the photosensitive member 1, as shown in FIG. 24. Therefore, as the bristles of the planted bristle layer 32*c* of the bristle planted elastic roller 32 move into the charging nip n, i.e. the contact portion between the photosensitive member 1 and the bristle planted elastic roller 32, they deform in various shapes, as shown in FIG. 24, as they make contact with the peripheral surface of the photosensitive member 1. As a result, the state of contact between the bristle planted elastic roller 32 and the photosensitive member 1 is improved.

Figure 25:
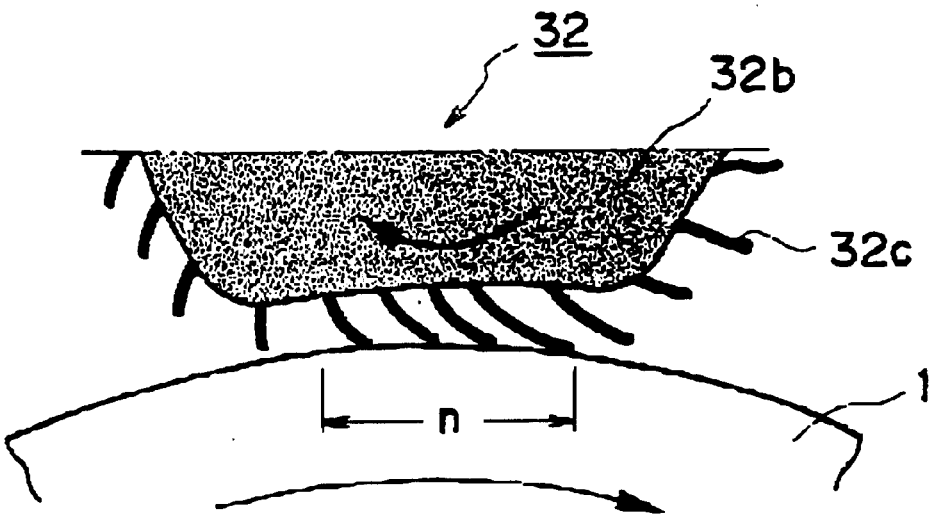
FIG. 25 is an enlarged schematic view of a charging nip in the case of codirectional contact sliding.

In comparison, if the bristle planted elastic roller 32 is rotated in such a direction that the extending direction of the bristles of the bristle planted elastic roller 32 coincides with the moving direction of the peripheral surface of the photosensitive member 1 in the charging nip n, the peripheral surface of the photosensitive member 1 is rubbed by the bristles of the bristle planted elastic roller 32, which are slanted in the same direction as the moving direction of the peripheral surface of the photosensitive member 1 as shown in FIG. 25. In this case, in the charging nip n, the bristles of the planted bristle layer 32*c* of the bristle planted elastic roller 32 may be bent only slightly more than they were originally bent, and their shapes remain substantially the same while the bristle planted elastic roller 32 is rotated. Therefore, the state of contact between the bristle planted elastic roller 32 and the photosensitive member 1 is less tight compared to the aforementioned state of contact between the bristle planted elastic roller 32 and the photosensitive member 1 in which the peripheral surface of the photosensitive member 1 is rubbed by the bristles of the bristle planted elastic roller 32 slanted in the direction opposite to the moving direction of the peripheral surface of the photosensitive member 1. Further, the amount of rubbing which occurs between the bristle planted elastic roller 32 and the photosensitive member 1 is only proportional to the peripheral velocity difference between the two. As a result, the photosensitive member 1 is sometimes insufficiently charged, on the areas which do not make satisfactory contact with the bristles of the bristle planted elastic roller 32.

In this embodiment, a DC voltage of −700 V is applied to the metallic core 32*a* of the bristle planted elastic roller 32, whereby the peripheral surface of the photosensitive member 1 is charged to a potential level substantially equal to the level of the applied voltage. In other words, in the case of the contact type charging of the photosensitive member 1 by the bristle planted elastic roller 32 in this embodiment, the direct charge injection process plays the dominant role, because the slanted bristles of the planted bristle layer 32*c* of the bristle planted elastic roller 32 rub the peripheral surface of the photosensitive member 1, leaving no portion of the peripheral surface of the photosensitive member untouched, in the charging nip n between the bristle planted elastic roller 32, and the photosensitive member 1 as the object to be charged.

Assuming that in this embodiment, the peripheral velocity of the bristle planted elastic roller 32, i.e. the velocity at which the peripheral surface of the bristle planted elastic roller 32 moves, is A mm/sec, and the peripheral velocity of the photosensitive member 1, i.e. the velocity at which the peripheral surface of the photosensitive member 1 moves, is B mm/sec, if B has a positive value, then A has a negative value because the bristle planted elastic roller 32 and the photosensitive member 1 are rotated in such directions that their peripheral surfaces move in the opposite directions in the charging nip n. Therefore, $B-A>0$. Further, the image forming apparatus is structured so that the direction in which the projections 2*c* are slanted coincides with the upstream direction relative to the rotational direction of the photosensitive member 1.

However, the structure of an image forming apparatus does not need to be limited to the above described one. For example, the bristle planted elastic roller 32 may be rotated in such a manner that the peripheral surfaces of the bristle planted elastic roller 32 and the photosensitive member 1 move in the same direction in the charging nip n. In such a case, an image forming apparatus is structured as described below .

That is, when the absolute value of A is smaller than that of B, in other words, when the peripheral velocity of the bristle planted elastic roller 32 is slower than that of the photosensitive member 1, $B-A>0$. In this case, the apparatus is structured so that the direction in which the projections 2*c* are slanted coincides with the upstream direction in terms of the rotational direction of the photosensitive member 1.

On the other hand, when the absolute value of A is greater than that of B, in other words, when the peripheral velocity of the bristle planted elastic roller 32 is faster than that of the photosensitive member 1, $B-A<0$. In this case, the apparatus is structured so that the direction in which the projections 2*a* are slanted coincides with the downstream direction in terms of the rotational direction of the photosensitive member 1.

With the above arrangement, the peripheral surface of the photosensitive member 1 moves against the grain of the peripheral surface of the bristle planted elastic roller 32 as the bristle planted elastic roller 32 and the photosensitive member 1 are driven.

When the photosensitive member 1 was charged using the above structure, the slanted bristles of the bristle planted layer 32*b* of the bristle planted elastic roller 32 hung up on the microscopic irregularities on the peripheral surface of the photosensitive member 1 as they came in contact with the peripheral surface of the photosensitive member 1, becoming deformed. Also, a satisfactory nip was formed due to the presence of the elastic layer 32*b*. As a result, the state of contact between the peripheral surfaces of the bristle planted elastic roller 32 and photosensitive member 1 became tighter and more uniform, and therefore, the photosensitive member 1 was desirably charged in terms of uniformly, without the need for increasing the peripheral velocity of the charging member, and/or the voltage charged to the charging member.

As for the photosensitive member, it is desirable to employ the one described in the embodiment illustrated in FIG. 7.

Embodiment 10

This embodiment is practically the same as Embodiment 9, except for the addition of the following feature. That is, the peripheral surface of the bristle planted elastic charging member is coated in advance with electrically conductive particles, or at least the nip portion between the bristle planted elastic charging member and an object to be charged is supplied with the electrically conductive particles. With the addition of this measure, the rotation of the bristle planted elastic charging member is stabilized, and the size of the contact area between the bristle planted elastic charging member and the object to be charged increases, improving the state of contact, and therefore, electrical charge can be directly injected into the object to be charged, more reliably and uniformly.

The electrically conductive particles are such particles that are intended to enhance the performance of the charge roller in charging the object. In other words, the object is charged through the contact type charging process, with the presence of the charging performance enhancing particles in the nip portion between the object to be charged and the contact type charging member.

With the presence of these charging performance enhancing particles, the bristle planted elastic charging member and the object to be charged can be more easily rotated in contact with each other while maintaining a peripheral velocity difference in the nip portion between the object to be charged and the bristle planted elastic charging member, because the charging performance enhancing particles serve as lubricant. At the same time, the charging performance enhancing particles present on the surfaces of the bristles improve the state of contact between the bristle planted elastic charging member and the object to be charged, enabling the bristle planted elastic charging member to make contact with the peripheral surface of the object to be charged, leaving no spot on the peripheral surface of the object to be charged untouched. This presence of the charging performance enhancing particles enables, in cooperation with the function of the aforementioned slanted bristles of the bristle planted elastic charging member, the extending direction of which opposes the rotational direction of the object to be charged, electrical charge to be directly infected, more reliably and uniformly.

Figure 26:
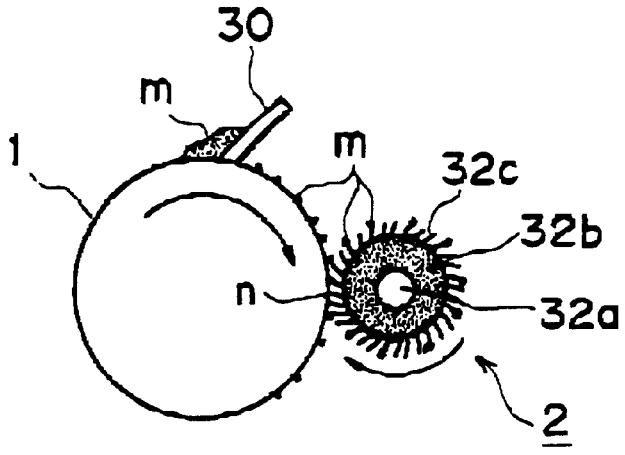
FIG. 26 is a schematic view of a charging device using charging-promotion particles.

This embodiment is such an embodiment that employs both the slanted bristles and the charging performance enhancing particles Referring to FIG. 26, a referential FIG. 1 designates an object to be charged, for example, an electrophotographic photosensitive member of a rotational drum type, and a referential FIG. 32 designates the bristle planted elastic roller as a contact type charging member. A referential FIG. 30 designates a regulating blade as a means for coating the charging performance enhancing particles, and a referential character m designates a charging performance enhancing particle.

a. Bristle Planted Charge Roller 32

The bristle planted roller 32 is the same as the one described in Embodiment 9. It is rotated in contact with the photosensitive member 1, maintaining a predetermined peripheral velocity difference from the photosensitive member 1, with the peripheral surface of the photosensitive member 1 moving against the grain, or the direction of the slanted bristles of the bristle planted elastic roller 32, to directly inject electrical charge into the photosensitive member 1.

b. Charging Performance Enhancing Particles m

The charging performance enhancing particles m employed in this embodiment are the same as those employed in Embodiment 4.

c. Charging Performance Enhancing Particle Coating Means 30

In this embodiment, in order to uniformly supply the charging nip n between the bristle planted elastic roller 32 and the photosensitive member 1 with the charging performance enhancing particles m, and hold them there, the charging performance enhancing particle coating means 30 is disposed on the upstream side of the charging nip n in terms of the rotational direction of the photosensitive member 1.

The charging performance enhancing particle coating means 30 in this embodiment is a regulating blade placed in contact with the photosensitive member 1, and is structured to hold the charging performance enhancing particles m between the photosensitive member 1 and the regulating blade 30.

With this structural arrangement, a predetermined amount of the charging performance enhancing particles m is coated on the peripheral surface of the photosensitive member 1 as the photosensitive member 1 is rotated, and is carried to the charging nip n to be uniformly distributed across the charging nip n.

The charging performance enhancing particle supplying structure does not need to be limited to the one described above; much simpler structures may be employed. For example, a method, in which a foamed member, or a fur brush, impregnated with the charging performance enhancing particles m is placed in contact with the object 1 to be charged or the bristle planted elastic roller 32, may be employed.

d. Direct Charge Injection

The photosensitive member 1 is in the form of a drum with a diameter of 30 mm, and is rotated at a constant peripheral velocity of 50 mm/sec.

As the photosensitive member 1 is rotated, the charging performance enhancing particles m are coated on the peripheral surface of the photosensitive member 1 by the regulating blade 30, and reach the charging nip n.

The bristle planted elastic roller 32 is driven at approximately 80 rpm so that the peripheral surfaces of the bristle planted elastic roller 32 and the photosensitive member 1 move at a constant velocity in the opposite directions in the charging nip n.

Figure 27:
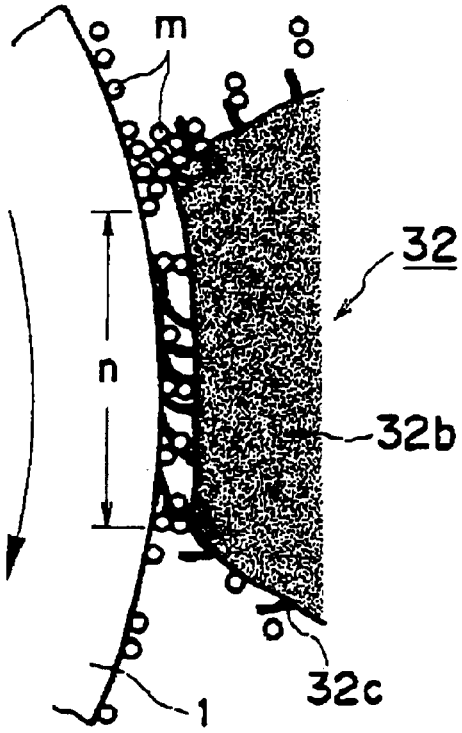
FIG. 27 is an enlarged schematic view of a charging nip.

Thus, in this embodiment, the planted bristles of the planted bristle layer 32*c* of the bristle planted elastic roller 32 make contact with the peripheral surface of the photosensitive member 1, deforming in various shapes, in the charging nip n, and at the same time, the charging performance enhancing particles m coated on the photosensitive member 1 are easily impregnated into the peripheral surface of the bristle planted elastic roller 32 due to the presence of the slanted bristles on the peripheral surface of the bristle planted elastic roller 32, as shown in FIG. 27 which is an enlarged schematic section of the charging nip n. In other words, the deformation of the slanted bristles, and the presence of the charging performance enhancing particles m, in the charging nip n, improve the state of contact between the bristle planted elastic roller 32 and the photosensitive member 1.

To the metallic core 32*a* of the bristle planted elastic roller 32, a DC voltage of −700 V is applied, whereby the peripheral surface of the photosensitive member 1 is charged to a potential level equal to the level of the applied voltage.

In other words, in the case of the contact type charging process in this embodiment, a process of direct charge injection plays the dominant role. That is, electrical charge is directly injected as the slanted bristles of the planted bristle layer 32*c* of the bristle planted elastic layer 32, and the charging performance enhancing particles m present in the charging nip n between the bristle planted elastic roller 32 and the photosensitive member 1, rub the peripheral surface of the photosensitive member 1, without leaving any spot on the peripheral surface of the photosensitive member untouched.

When the photosensitive member 1 was charged by a charging apparatus with the structure described above, the slanted bristles of the planted bristle layer 32*c* hung up on the peripheral surface of the photosensitive member 1, deforming in various shapes, as they come in contact with the peripheral surface of the photosensitive member 1. Further, the image forming apparatus was structured so that the charging performance enhancing particles m could be easily picked up by the peripheral surface of the bristle planted elastic roller 32. As a result, the bristle planted elastic roller 32 made contact with the peripheral surface of the photosensitive member 1, tighter and more uniformly. Consequently, the photosensitive member 1 was desirably charged in terms of the uniformity of charge.

According to an experiment, a desirable amount of the charging performance enhancing particles m in the charging nip n was $10^3$–$5\times10^5$ particle/mm$^2$.

Embodiment 11

In this embodiment, the present invention is embodied in the form of a cleanerless (toner recycling) image forming apparatus, i.e. an image forming apparatus which does not have a cleaning apparatus. As for the contact type charging member, a bristle planted elastic roller is employed. Also, in order to improve the state of contact between the charging member and the photosensitive member, the apparatus is structured so that the charging performance enhancing particles are supplied between the charging member and the photosensitive member. Further, in order to improve the chargeability of the photosensitive member, the photosensitive member is provided with a charge injection layer as the surface layer. As a result, not only is the charging performance improved, but also, images which do not suffer from the flaws associated with the residual toner particles can be outputted by the image forming apparatus, in spite of the fact that the apparatus does not comprise a cleaning apparatus.

Figure 28:
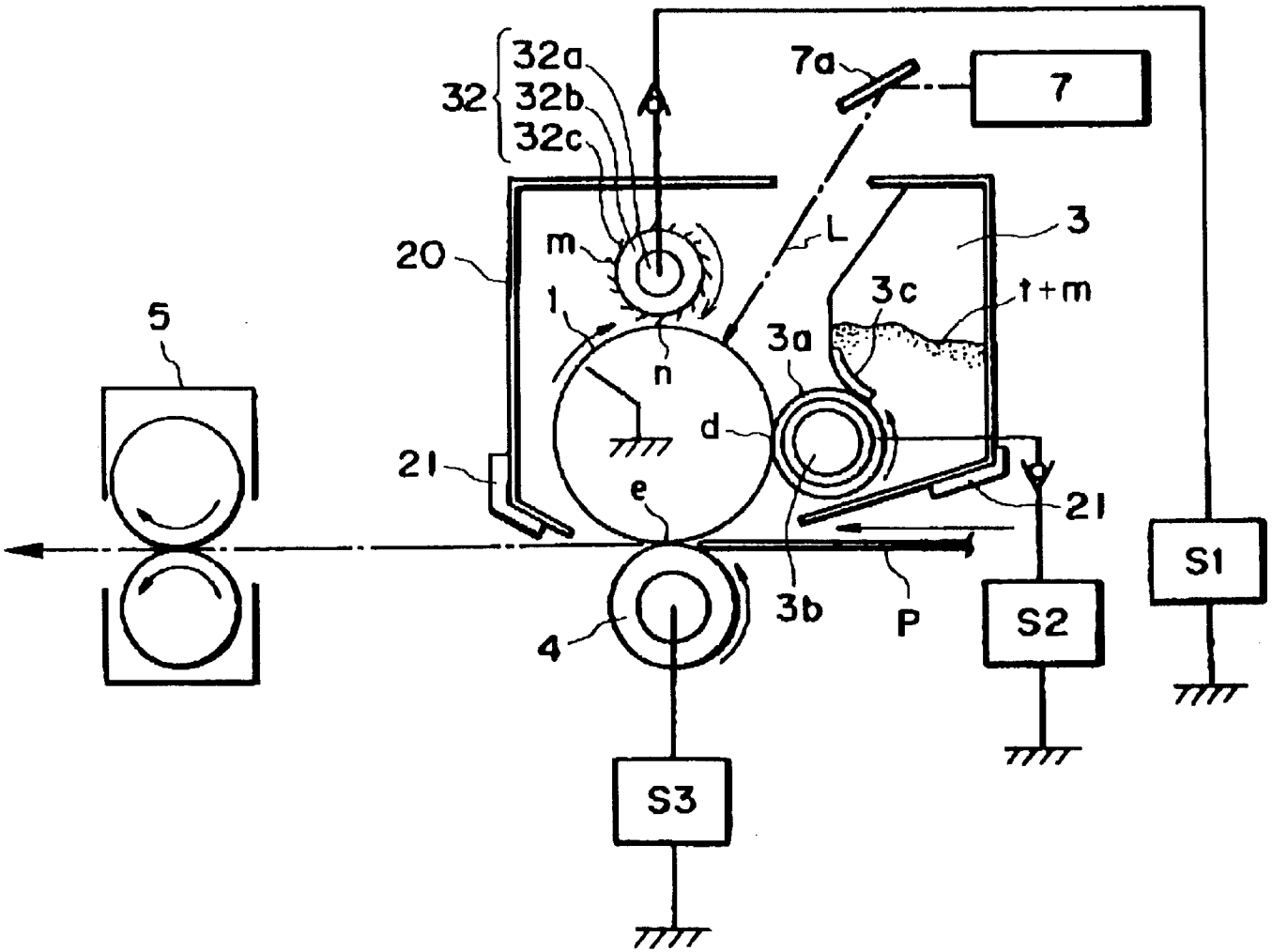
FIG. 28 is a schematic view of a cleanerless type image forming apparatus.

FIG. 28 is a schematic section of the cleanerless image forming apparatus in this embodiment, and depicts the general structure thereof. The printer in this embodiment is substantially identical to the printer in Embodiment 9, except that this printer lacks the cleaning apparatus 6. The structural members or portions which are the same as those in the printer in Embodiment 9 are designated with the same referential codes as those used in Embodiment 6 to omit the repetition of the same descriptions.

a. Photosensitive Member 1

The photosensitive member 1 is such a photosensitive member that has a charge injection layer 16 as the surface layer, like the photosensitive member 1 in Embodiment 2.

b. Bristle Planted Elastic Roller 32

The bristle planted elastic roller 32 in this embodiment is the same as the one described in Embodiment 9. Electrical charge is directly injected into the photosensitive member 1 by rotating the bristle planted elastic roller 32 and photosensitive member 1 in such a manner that the peripheral surface of the photosensitive member 1 moves against the grain, or the extending direction of the slanted bristles of the bristle planted elastic roller 32, maintaining a peripheral velocity difference between the bristle planted elastic roller 32 and photosensitive member 1.

As for the structural arrangement for providing the bristle planted elastic roller 32 and the photosensitive member 1 with a peripheral velocity difference, it is desirable that in order to temporarily recover the residual toner particles as they are recovered in the case of a cleanerless image forming apparatus such as the one in this embodiment, the bristle planted elastic roller 32 is rotatively driven in such a direction that its rotational direction in the charging nip n opposes the rotational direction of the photosensitive member 1 in the charging nip n.

c. Charging Performance Enhancing Particles m

In this embodiment, the charging performance enhancing particles m are coated on the surface of the bristle planted elastic roller 32 in advance, so that the photosensitive member 1 can be desirably charged from the very start of each charging process.

Further. the charging performance enhancing particles m are mixed by two parts in weight in the single component magnetic toner t, as developer, stored in the developing apparatus 3.

The charging performance enhancing particles m mixed in the developer t adhere to the peripheral surface of the photosensitive member 1 when an electrostatic latent image on the peripheral surface of the photosensitive member 1 is developed, and then are supplied to the charging nip n by being carried to the charging nip n, through the transfer nip e, as the photosensitive member 1 is rotated.

The charging performance enhancing particles m employed in this embodiment are electrically conductive zinc oxide particles with a diameter of 3 $\mu$m. They are desired to be nearly colorless or white so that they do not interfere with an exposing process for forming a latent image, in particular, when they are used for enhancing the efficiency with which a photosensitive member is charged. Further, when they are used to enhance color recording, they are desired to be nearly colorless or white, in consideration of the fact that the charging performance enhancing particles m might be transferred onto a recording sheet P from a photosensitive member. Further, in order to prevent the charging performance enhancing particles m from scattering the light when a photosensitive member is exposed for latent image formation, the size of the charging performance enhancing particle m is desired to be smaller than the size of a picture element.

d. Direct Charge Injection

The photosensitive member 1 is in the form of a drum with a diameter of 30 mm, and is rotated at a constant peripheral velocity of 50 mm/sec. The bristle planted elastic roller 32 is driven at approximately 80 rpm, in such a manner that the peripheral surfaces of the bristle panted elastic roller 32 and the photosensitive member 1 move at constant velocities in the opposite directions in the charging nip n. To the metallic core 32*a* of the bristle planted elastic roller 32, a DC voltage of −700 V is applied.

Also in this embodiment, the slanted bristles of the planted bristle layer 32*c* of the bristle planted elastic roller 32 make contact with the peripheral surface of the photosensitive member 1, deforming in various shapes, in the charging nip n, and as they come in contact with the peripheral surface of the photosensitive member 1, the charging performance enhancing particles m present in the charging nip n are picked up, or scooped up, into the planted bristle layer 32*c* of the bristle planted elastic roller 32 by the slanted bristles of the bristle planted elastic roller 32. This deformation of the slanted bristles, and the presence of the charging performance enhancing particles m in the charging nip n, combine to improve the state of contact between the bristle planted elastic roller 32 and the photosensitive member 1.

With the above arrangement, the peripheral surface of the photosensitive member 1 is charged to a potential level equal to the level of the applied voltage. That is, in the case of the contact type charging system in this embodiment, the direct charge injection process plays the dominant role; the slanted bristles of the bristle planted elastic roller 32, and the charging performance enhancing particles m present in the charging nip n between the bristle planted elastic roller 32 and the photosensitive member 1 coordinate to rub the peripheral surface of the photosensitive member 1, leaving no portion of the peripheral surface of the photosensitive member 1 untouched, to directly inject charge into the photosensitive member 1.

e. Cleanerless System

As described above, the rotating photosensitive member 1 is charged by the bristle planted elastic roller 32, to substantially the same potential level as the level of the voltage applied to the bristle planted elastic roller 32, through the direct charge injection process. Then, the charged surface of the photosensitive member 1 is exposed to a scanning laser beam L from a laser beam scanner 7, and as a result, an electrostatic latent image correspondent to a desired print pattern is formed on the peripheral surface of the rotating photosensitive member 1.

Then, the electrostatic latent image is developed in reverse into a toner image by the developing apparatus 3, and the toner image is sequentially transferred from one end to the other onto a transfer sheet P, as recording medium, delivered at a predetermined timing to the transfer nip e from an unillustrated sheet feeding section.

After receiving the toner image in the transfer nip e, the transfer sheet P is separated from the peripheral surface of the rotating photosensitive member 1, and is introduced into a fixing apparatus 5, in which the toner image is permanently fixed to the transfer sheet P. Thereafter, the transfer sheet P is discharged as a print or a copy from the image forming apparatus.

In the case of a cleanerless image forming apparatus, the residual toner particles (developer particles), i.e. the toner particles remaining on the peripheral surface of the photosensitive member 1 after toner image transfer, are carried virtually undisturbed to the charging nip n, i.e. the contact portion between the bristle planted elastic roller 32 and the photosensitive member 1 as the photosensitive member 1 is rotated. In the charging nip n, the residual toner particles are adhered to, or impregnated into, the bristle planted elastic roller 32 while being stirred by the slanted bristles 32 of the bristle planted elastic roller 32, which extend in the direction opposite to the rotational direction of the photosensitive member 1 (the residual toner particles are temporarily recovered by the bristle planted elastic roller 32). Because the toner particles are generally insulator, their adhesion to, or impregnation into, the bristle planted elastic roller 32 becomes one of the factors that are responsible for improper charging of the photosensitive member 1.

However, in this embodiment, the charging performance enhancing particles m are coated in advance on the bristle planted elastic roller 32, and the charging performance enhancing particles m mixed in the developer t (toner) in the developing apparatus are carried to the charging nip n through the developing and transferring processes, and are supplied to the bristle planted elastic roller 32. Therefore, the charging performance enhancing particles m are always present in the charging nip n to keep the state of contact between the bristle planted elastic roller 32 and the photosensitive member 1 tight enough to maintain desirable contact resistance between the bristle planted elastic roller 32 and the photosensitive member 1. As a result, in spite of the contamination of the bristle planted elastic roller 32 by the residual toner particles, charge can be directly injected. In other words, electrical charge can be directly and continuously injected into the photosensitive member 1 with the application of relatively low voltage to the bristle planted elastic roller 32, thus generating substantially no ozone, to uniformly charge the photosensitive member 1.

The residual toner particles which adhere to, or are impregnated into, the bristle planted elastic roller 32, are electrically discharged from the bristle planted elastic roller 32 gradually onto the photosensitive member 1. Since the bristle planted elastic roller 32 bears the charging performance enhancing particles m in this embodiment, the strength with which the residual toner particles adhere to the bristle planted elastic roller 32 is reduced, improving the efficiency with which the residual toner particles are discharged from the bristle planted elastic roller 32 onto the photosensitive member 1.

After being discharged onto the photosensitive member 1 from the bristle planted elastic roller 32, the residual toner particles arrive at the developing station d as the peripheral surface of the photosensitive member 1 is rotatively moved. Then, they are recovered by the developing apparatus 3 (cleaning process carried out at the same time and location as developing process), or used for the developing process (toner recycling).

As described previously, in the process in which both cleaning and image development occur at the same time and location, the toner particles remaining on the photosensitive member 1 after image transfer are recovered during the developing process of the immediately following image formation cycle In other words, in the immediately following image forming cycle, the photosensitive member 1, on which the residual toner particles remain, is charged, without removal of the residual toner particles, and exposed to form a latent image on the photosensitive member 1. Then, when the latent image is developed, the residual toner particles are recovered by the fog prevention bias Vback, that is, the difference between the level of the DC voltage applied to the developing apparatus 3, and the surface potential level of the photosensitive member 1, in the development apparatus 3. When the reversal development process is employed as it is by the printer in this embodiment, the cleaning-developing process is carried out by the functions of an electric field for recovering the residual toner particles onto a developing sleeve front the "dark" regions of the latent image on the peripheral surface of the photosensitive member 1, and an electrical field for adhering the toner particles to the "light" regions of the latent image on the peripheral surface of the photosensitive member 1.

Through repetition of the above described processes, electrical charge is directly injected into the photosensitive member 1, while recycling the toner, for a long period of service. The residual toner particles and the charging performance enhancing particles are picked up into the bristle planted elastic roller 32 while being stirred, and therefore, flawless images, which do not suffer from the ghosts attributable to the residual toner particles, can be outputted.

When images were outputted by the image forming apparatus in this embodiment, even the 5000th copy did not suffer from the ghosts attributable to the cleanerless structure of the apparatus; the charging performance of the apparatus remained stable.

In this embodiment, the residual toner particles are satisfactorily recovered, while being stirred, by the slanted bristles of the bristle planted elastic roller 32, which extend in the direction opposite to the rotational direction of the photosensitive member 1, and in addition, the slanted bristles and the charging performance enhancing particles m coordinate to make the state of contact between the bristle planted elastic roller 32 and the photosensitive member 1 satisfactorily tight for desirably charging the photosensitive member 1. Therefore, the image forming apparatus can output desirable images which do not suffer from flaws attributable to the passing of the residual toner particles through the charging nip n, or attributable to the improper charging of the photosensitive member 1, in spite of the fact that the image forming apparatus is of a cleanerless type.

The charging performance enhancing particles m mixed into the single component magnetic toner t, as the developer, stored in the developing apparatus 3 adhere to the peripheral surface of the photosensitive member 1 during the development of an electrostatic latent image on the peripheral surface of the photosensitive member 1, and are supplied to the charging nip n by being carried to the charging nip n, through the transfer nip e, as the photosensitive member 1 is rotated.

More specifically, the toner image developed on the photosensitive member 1 actively transfers onto the transfer sheet P by being attracted toward the transfer sheet P by the transfer bias, in the transfer nip e, whereas the charging performance enhancing particles m having adhered to the peripheral surface of the photosensitive member 1 during the latent image development on the peripheral surface of the photosensitive member 1 by the developing apparatus 3 do not actively transfer onto the transfer sheet P side, remaining adhered to the peripheral surface of the photosensitive member 1, practically undisturbed, because the charging performance enhancing particles m have a low electrical resistance value. Then, the charging performance enhancing particles m remaining on the peripheral surface of the photosensitive member 1 are supplied to the charging nip n by being carried to the charging nip n, through the transfer nip e, as the peripheral surface of the photosensitive member 1 rotationally moves.

As is evident from the above description, in this embodiment, the peripheral surface of the bristle planter elastic roller 32 is provided with the charging performance enhancing particles m, which are coated in advance on the peripheral surface of the bristle planted elastic roller 32, and also the charging performance enhancing particles m mixed in the developer t in the developing apparatus 3 are supplied to the bristle planted elastic roller 32 through the developing and transferring processes. Therefore, even when the residual toner particles adhere to, are impregnated into, the bristle planted elastic roller 32, the state of contact between the bristle planted elastic roller 32 and the photosensitive member 1 is kept tight enough to maintain desirable contact resistance between the bristle planted elastic roller 32 and the photosensitive member 1 for directly injecting electrical charge into the photosensitive member 1. Further, the charging performance enhancing particles m are continuously supplied from the developing apparatus 3, and therefore, even if the charging performance enhancing particles m fall off the bristle planted elastic roller 32, the desirable charging performance can be maintained. In other words, the desirable charging performance can be maintained from the very beginning through the long service life of the image forming apparatus.

Miscellaneous Embodiments

1. The charging member may be in the form of a rotative endless belt. In this case, the rotational direction of the belt in the nip portion may be rendered the same as that of an object to be charged, in the nip portion. However, rotating the belt in the counter direction relative to the rotational direction of the object to be charged, in the nip portion, is advantageous because the counter direction can increase the amount of contact between the charging member and the object to be charged, without the need for increasing the rotational velocity of the charging member.

2. The charge bias applied to a charging member may comprise a component constituted of alternating voltage (AC component i.e. voltage the potential level of which periodically changes). The alternating voltage may be in the form of sine wave, rectangular wave, triangular wave, or the like. It may also be in the form of rectangular wave formed by periodically turning on and off a direct current power source.

3. It is obvious that a charging apparatus in accordance with the present invention is effective to electrically charge an object other than the image bearing member of an image forming apparatus.

4. When the present invention is applied to an image forming apparatus, the exposing means, i.e. the means for writing image data on the charged surface of the photosensitive member as an image bearing member, may be an exposing means other than the scanning laser beam based exposing means described in the preceding embodiments. For example, it may be a digital exposing means employing an array of solid state light emitting elements such as LED's, or an analog exposing means employing a halogen lamp, a fluorescent lamp, or the like, as a source for illuminating a target image.

In summary, it may be any if it can form an electrostatic latent image corresponding to the image information.

5. The image bearing member may be an electrostatic recording dielectric member. In such a case, the dielectric member surface is uniformly charged (primary charging) to a predetermined polarity and potential, and then, selective discharging is effected by discharging means such as a discharging needle head, electron gun or the like to form an electrostatic latent image pattern corresponding to the intended image information.

6. in the image forming apparatus, the toner developing system or means for the electrostatic latent image may be of any type. It may be a regular developing system or a reverse development type.

As for a toner developing method for an electrostatic latent image, there are many types which are classified into the following four types (a–d):

a. Non-magnetic toner is applied on a sleeve using a blade or the like, or a magnetic toner is applied on a sleeve by magnetic force, and is carried to a developing zone where it is faced to the photosensitive member without contact thereto (one component non-contact development).

b. The toner applied in the same manner is contacted to the photosensitive member (one component contact development).

c. A developer (two component developer) in the form of a mixture of toner particles and magnetic carrier particles is fed using magnetic force, and is contacted to the photosensitive member(two component contact development).

d. The two component developer is used, and is not contacted to the photosensitive member (two component non-contact type development).

among them, the two component contact developing method(c) is widely used because of the high image quality and highly stability thereof.

7. the transferring means 4 is not limited to the roller transfer type, but a belt transfer type or corona discharge transfer are usable.

8. Using the transfer drum, transfer belt or another intermediary transfer member, a multi-color image or a full-color image in addition to the monochromatic image can be formed using superimposing transfer.

9. the image forming apparatus is not limited to the transfer type machine, but the present invention is applicable to a direct type image forming apparatus, or an image forming apparatus in the form of an image display device.

What is claimed is:

1. A charging apparatus comprising:

a charging member for being supplied with a voltage to charge a member to be charged, the charging member including an elastic member contacting with the member to be charged and a plurality of projections which are provided at a surface of the elastic member and which are inclined relative to a normal line of a surface of said charging member; and supplying means for supplying electroconductive particles so that particles are provided in a contacting portion between the member to be charged and said charging member, wherein said charging member carries the electroconductive particles, wherein a speed A of a surface of said charging member and a speed B of a surface of the member to be charged satisfy:

$$B-A>0$$

wherein the plurality of projections are inclined upstream with respect to a movement direction of the surface of the member to be charged.

2. An apparatus according to claim 1, wherein the plurality of projections are inclined not less than 10° relative to a normal direction of said charging member.

3. An apparatus according to claim 1, wherein said elastic member includes a foam member.

4. An apparatus according to claim 1, wherein said charging member includes a roller.

5. An apparatus according to claim 1, wherein a movement direction of said charging member is opposite from a movement direction of the member to be charged at the contacting portion.

6. An apparatus according to claim 1, wherein the electroconductive particles have a volume resistivity not more than $1\times10^{12}$ Ωcm.

7. An apparatus according to claim 1, wherein said charging member effects injection charging to the member to be charged at the contacting portion.

8. A charging apparatus comprising:

a charging member for being supplied with a voltage to charge a member to be charged, the charging member including an elastic member contacting with the member to be charged and a plurality of projections provided at a surface of the elastic member and which are inclined relative to a normal line of a surface of said charging member; and supplying means for supplying electroconductive particles so that particles are provided in a contacting portion between the member to be charged and said charging member, wherein said charging member carries the electroconductive particles, wherein a speed A of a surface of said charging member and a speed of a surface of the member to be charged satisfy:

$$B-A>0$$

wherein the plurality of projections are inclined downstream with respect to a movement direction of the surface of the member to be charged.

9. An apparatus according to claim 8, wherein the plurality of projections are inclined not less than 10° relative to a normal direction of said charging member.

10. An apparatus according to claim 8, wherein the elastic member includes a foam member.

11. An apparatus according to claim 8, wherein said charging member includes a roller.

12. An apparatus according to claim 8 wherein the electroconductive particles have a volume resistivity not more than $1\times10^{12}$ Ωcm.

13. An apparatus according to claim 8, wherein said charging member effects injection charging to the member to be changed at the contacting portion.

14. A charging apparatus comprising:

a charging member for being supplied with a voltage to charge a member to be charged, the charging member including an elastic member contacting with the member to be charged and a plurality of projections which are provided at a surface of the elastic member and which are inclined relative to a normal line of a surface of said charging member; and supplying means for supplying electroconductive particles so that particles are provided in a contacting portion between the member to be charged and said charging member;

wherein the plurality of projections have a diameter of 5–10 microns, a length of 5–200 microns, and a density of the projections is 10–200/mm, wherein a speed A of a surface of said charging member and a speed B of a surface of the member to be charged satisfy:

$$B-A>0$$

wherein the plurality of projections are inclined upstream with respect to a movement direction of the surface of the member to be charged.

15. An apparatus according to claim 14, wherein the plurality of projections are inclined not less than 10° relative to a normal direction of said charging member.

16. An apparatus according to claim 14, wherein the elastic member includes a foam member.

17. An apparatus according to claim 14, wherein said charging member includes a roller.

18. An apparatus according to claim 14, wherein a movement direction of said charging member is opposite from a movement direction of the member to be charged at the contacting portion.

19. An apparatus according to claim 14, wherein the electroconductive particles have a volume resistivity not more than $1\times10^{12}$ Ωcm.

20. An apparatus according to claim 14, wherein said charging member effects injection charging to the member to be charged at the contacting portion.

21. A charging apparatus comprising:

a charging member for being supplied with a voltage to charge a member to be charged, the charging member including an elastic member contacting with the member to be charged and a plurality of projections provided at a surface of the elastic member and which are inclined relative to a normal line of a surface of said charging member; and supplying means for supplying electroconductive particles so that particles are provided in a contacting portion between the member to be charged and said charging member, wherein the plurality of projections have a diameter of 5–10 microns, a length of 5–200 microns, and a density of the projections is 10–200/mm, wherein a speed A of a surface of said charging member and a speed B of a surface of the member to be charged satisfy:

$$B-A<0$$

wherein the plurality of projections are inclined downstream with respect to a movement direction of the surface of the member to be charged.

22. An apparatus according to claim 21, wherein the plurality of projections are inclined not less than 10° relative to a normal direction of said charging member.

23. An apparatus according to claim 21, wherein the elastic member includes a form member.

24. An apparatus according to claim 21, wherein said charging means includes a roller.

25. An apparatus according to claim 21, wherein the electroconductive particles have a volume resistivity not more than $1\times10^{12}$ Ωcm.

26. An apparatus according to claim 21, wherein said charging member effects injection charging to the member to be charged at the contacting portion.

27. A charging apparatus comprising:

a charging member for being supplied with a voltage to charge a member to be charged, the charging member including an elastic member contacting with the member to be charged and a plurality of projections which are provided at a surface of the elastic member and which are inclined relative to a normal line of a surface of said charging member, wherein said charging member carries electroconductive particles, and particle sizes of the electroconductive particles not more than 50 μm, wherein a speed A of a surface of said charging member and a speed B of a surface of the member to be charged satisfy:

$$B-A>0$$

wherein the plurality of projections are inclined upstream with respect to a movement direction of the surface of the member to be charged.

28. An apparatus according to claim 27, wherein the plurality of projections are inclined not less than 10° relative to a normal direction of said charging member.

29. An apparatus according to claim 27, wherein the elastic member includes a foam member.

30. An apparatus according to claim 27, wherein said charging member includes a roller.

31. An apparatus according to claim 27, wherein a movement direction of said charging member is opposite from a movement direction of the member to be charged at a contacting portion between the member to be charged and said charging member.

32. An apparatus according to claim 27, further comprising the electroconductive particles provided in a contacting portion between the member to be charged and said charging member.

33. An apparatus according to claim 27, further comprising supplying means for supplying the electroconductive particles so that particles are provided in a contacting portion between the member to be charged and said charging member.

34. An apparatus according to claim 32, wherein the electroconductive particles have a volume resistivity not more than $1\times10^{12}$ Ωcm.

35. An apparatus according to claim 27, wherein said charging member effects injection charging to the member to be charged at a contacting portion between the member to be charged and said charging member.

36. A charging apparatus comprising:

a charging member for being supplied with a voltage to charge a member to be charged, the charging member including an elastic member contacting with the member to be charged and a plurality of projections provided at a surface of the elastic member and which are inclined relative to a normal line of a surface of said charging member;

wherein said charging member carries electroconductive particles, and particle sizes of the electroconductive particles are not more than 50 μm, wherein a speed A of a surface of said charging member and a speed B of a surface of the member to be charged satisfy:

$$B-A<0$$

wherein the plurality of projections are inclined downstream with respect to a movement direction of the surface of the member to be charged.

37. An apparatus according to claim 36, wherein the plurality of projections are inclined not less than 10° relative to a normal direction of said charging member.

38. An apparatus according to claim 36, wherein the elastic member includes a foam member.

39. An apparatus according to claim 36, wherein said charging member includes a roller.

40. An apparatus according to claim 36, further comprising the electroconductive particles provided in a contacting portion between the member to be charged and said charging member.

41. An apparatus according to claim 36, further comprising supplying means for supplying the electroconductive particles so that particles are provided in a contacting portion between the member to be charged and said charging member.

42. An apparatus according to claim 40, wherein the electroconductive particles have a volume resistivity nor more than $1\times10^{12}$ Ωcm.

43. An apparatus according to claim 36, wherein said charging member effects injection charging to the member to be charged at a contacting portion between the member to be charged and said charging member.

* * * * *

UNITED STATES PATENT AND TRADEMARK OFFICE

CERTIFICATE OF CORRECTION

PATENT NO. : 6,473,582 B2
DATED : October 29, 2002
INVENTOR(S) : Harumi Ishiyama et al.

It is certified that error appears in the above-identified patent and that said Letters Patent is hereby corrected as shown below:

Column 1,
Line 61, “a” should be deleted.

Column 4,
Line 9, “tog” should read -- fog --.

Column 6,
Line 59, “drug,” should read -- drum, --.

Column 10,
Line 57, “interior” should read -- inferior --.

Column 11,
Line 49, “n.” should read -- n, --.

Column 12,
Line 6, “wards,” should read -- words, --.

Column 30,
Line 54, “rotated” should read -- rotated. --.

Column 35,
Line 32, “he” should read -- the --.

Column 37,
Line 21, “uniformly,” should read -- uniformity --.

Column 38,
Line 1, “infected,” should read -- injected, --.

Column 43,
Line 8, “front” should read -- from --.

Column 46,
Line 46, “claim 8” should read -- claim 8, --; and
Line 51, “changed” should read -- charged --.

Column 47,
Line 56, “form” should read -- foam --.

UNITED STATES PATENT AND TRADEMARK OFFICE

CERTIFICATE OF CORRECTION

PATENT NO. : 6,473,582 B2
DATED : October 29, 2002
INVENTOR(S) : Harumi Ishiyama et al.

It is certified that error appears in the above-identified patent and that said Letters Patent is hereby corrected as shown below:

Column 50,
Line 5, "nor" should read -- not --.

Signed and Sealed this

Fourteenth Day of October, 2003

JAMES E. ROGAN
*Director of the United States Patent and Trademark Office*